US005888685A

United States Patent [19]

Kuroda et al.

[11] Patent Number: 5,888,685

[45] Date of Patent: Mar. 30, 1999

[54] ELECTROPHOTOGRAPHIC PHOTOCONDUCTOR

[75] Inventors: Masami Kuroda; Ayako Tutui, both of Kanagawa; Yoshimasa Tomiuchi; Kenji Kawate, both of Nagano, all of Japan

[73] Assignee: Fuji Electric Co., Ltd.

[21] Appl. No.: 881,264

[22] Filed: Jun. 24, 1997

[30] Foreign Application Priority Data

Jun. 26, 1996 [JP] Japan ..... 8-184261
Feb. 27, 1997 [JP] Japan ..... 9-043170

[51] Int. Cl.[6] ..... G03G 5/09

[52] U.S. Cl. ..... 430/83; 430/58; 430/59; 430/75

[58] Field of Search ..... 430/58, 75, 83, 430/132, 134

[56] References Cited

U.S. PATENT DOCUMENTS

| | | | |
|---|---|---|---|
| 5,089,365 | 2/1992 | Kuroda et al. | 430/75 |
| 5,252,416 | 10/1993 | Kuroda et al. | 430/58 |
| 5,486,438 | 1/1996 | Shoshi et al. | 430/83 |

FOREIGN PATENT DOCUMENTS

| | | |
|---|---|---|
| 6-123986 | 10/1992 | Japan . |
| 6-59483 | 3/1994 | Japan . |
| 7-07211 | 1/1995 | Japan . |

*Primary Examiner*—Roland Martin
*Attorney, Agent, or Firm*—Morrison Law Firm

[57] ABSTRACT

An electrophotographic photoconductor contains at least a furan derivate or a thiophene derivate as the charge transport agent in a photoconductive layer thereof.

3 Claims, 21 Drawing Sheets

I

II

I II

I II-1 II-2

I-17

I-18

I-19

I-20

I-21

I-22

I-23

I-24

II-1

II-2

II-3

II-4

II-5

II-6

II-7

II-8

II-9

II-10

II-11

II-12

(III−19)

(III−20)

(III−21)

(III−22)

(III−23)

(III−24)

(Ⅵ-23)

(Ⅵ-24)

(Ⅵ-25)

(Ⅵ-26)

(Ⅵ-27)

(Ⅵ-28)

(Ⅵ-29)

(Ⅵ-30)

(Ⅵ-31)

(Ⅵ-32)

(Ⅵ-33)

(Ⅵ-34)

(Ⅵ-35)

(Ⅵ-36)

(Ⅵ-37)

(Ⅵ-38)

(Ⅵ-39)

(Ⅵ-40)

(Ⅵ-41)

(Ⅵ-42)

(Ⅵ-43)

(Ⅵ-44)

(Ⅵ-45)

ELECTROPHOTOGRAPHIC PHOTOCONDUCTOR

BACKGROUND OF THE INVENTION

The present invention relates to a photoconductive layer of the electrophotographic photoconductors used in devices such as printers and copying machines that employ electrophotographic processes. More specifically, the present invention relates to constituent materials of the photoconductive layer.

The photosensitive materials of a conventional electrophotographic photoconductor (hereinafter simply referred to as a "photoconductor") used for devices such as printers, facsimiles, digital copying machines and analog copying machines, that employ electrophotographic processes, include inorganic photoconductive materials such as selenium and selenium alloys, inorganic photoconductive materials such as zinc oxide and cadmium oxide dispersed into a resin binder, organic photoconductive materials such as poly-N-vinylcarbazole and poly(vinyl anthracene), and other organic photoconductive materials such as phthalocyanine compounds and bisazo compounds dispersed into a resin binder or deposited by vacuum deposition.

It is required for the photoconductor to exhibit the functions for retaining surface charges in the dark, for generating electric charges in response to the received light, and for transporting the electric charges in response to the received light. The photoconductor may be classified into two types: 1) the mono-layered-type that exhibits the above described functions by one single photoconductive layer and 2) the so-called laminate-type consists of a layer mainly for charge generation, and a second layer for charge retention in the dark and charge transport in response to the received light.

For image formation by the electrophotographic techniques and with these types of photoconductors, Carlson's process can be applied as an example. The Carlson's process for image formation includes the steps of 1) charging of the photoconductor by corona discharge in the dark, 2) formation of electrostatic latent images of the letters and figures in a manuscript on the charged surface of the photoconductor, 3) development of the electrostatic latent images with toner, and 4) fixing of the developed toner images on a paper and such carriers. The photoconductor is reused after removal of the charge, removal of the residual toner, and removal of the optical charge.

Various image formation steps are employed in the Carlson's process. The corotron method or the scrotron method that uses metal wire and the contact charging method that uses the charging brush or charging roller are adopted for charging the photoconductor. Methods such as the two-components development method, nonmagnetic-single-component development method and magnetic-single-component development method are used in the development step.

Recently, the organic photoconductors have been developed by virtue of the flexibility, thermal stability and ease of film formation thereof. U.S. Pat. No. 3,484,237 discloses a photoconductor that includes poly-N-vinyl carbazole and 2,4,7-trinitrofluorenone. Japanese Unexamined Laid Open Patent Application No. S47-37543 discloses a photoconductor that includes an organic pigment as the main component thereof. Japanese Unexamined Laid Open Patent Application No. S47-10785 discloses a photoconductor that includes an eutectic complex consisting of a dye and resin as the main component thereof. At present, the function-separation-type organic photoconductors, which include a charge generation layer and a charge transport layer, are mainly used. The charge generation layer comprises metal-free phthalocyanine, metal phthalocyanine such as titanyl phthalocyanine or azo compound and a resin binder. The charge transport layer comprises a hydrazone compound, styryl compound, diamine compound or butadiene compound and a resin binder.

Among the function-separation-type photoconductors which laminate a charge generation layer on a conductive substrate and a charge transport layer on to the charge generation layer, negative-charging photoconductors exhibit sensitivity when the photoconductor surface is charged negatively, because the hole contributes to charge transport due to the nature of the charge transport material that functions as the electron donor. However, the corona discharge for negative-charging is unstable compared with the corona discharge for positive-charging. The corona discharge for negative-charging generates ozone and nitrogen oxide. The photoconductor surface is deteriorated physically and chemically by the ozone and nitrogen oxide absorbed thereto. Ozone and nitrogen oxide are very hazardous for the environmental safety. Accordingly, positive-charging photoconductors can be in practice more freely used and more widely used than negative-charging photoconductors.

Various positive-charging photoconductors have been proposed. Some positive-charging photoconductors, which include a single-layered photoconductive layer comprising a charge generation agent and a charge transport agent, both dispersed into a resin binder, have been put into practical use. However, the sensitivity of these positive-charging photoconductors of the single-layered type is not so high enough to be applicable to the high speed machines. More improvements are necessary for repeatedly using the positive-charging photoconductors of the single-layered type.

Laminate-type positive-charging photoconductors for high-speed use may be constructed by laminating a charge generation layer on a charge transport layer. However, corona discharge, light irradiation and mechanical wear pose problems of stability for repeated use of the photoconductor, since the charge generation layer is exposed on the surface of the photoconductor. The protection layer, disposed on the charge generation layer to avoid the mechanical wear of the charge generation layer, is problematic for improving the sensitivity and electrical properties of the photoconductor.

Laminate-type positive-charging photoconductors which include a charge transport layer on a charge generation layer have been proposed. The charge transport materials including 2,4,7-trinitrofluorenone may be used. However, 2,4,7-trinitro-9-fluorenone is a carcinogen. The Japanese Unexamined Laid Open Patent Applications No. S50-131941, No. H06-59483 and No. H06-123986 disclose cyano compounds and quinone compounds as the charge transport agent. Nonetheless, no charge transport agent that can be satisfactorily used for the laminate-type positive-charging photoconductor has yet been obtained.

Although the organic photoconductive materials have many merits which the inorganic photoconductive materials do not have, the conventional organic photoconductive materials do not exhibit all the properties required for electrophotographic photoconductors. It is required to fabricate a highly sensitive photoconductor that exhibits little change in the properties thereof after the photoconductor is continuously used in the electrophotographic apparatus continuous for a long time. Especially, the customer's demands are increasing for photoconductors, which can endure long continuous use in various electrophotographic apparatuses provided the foregoing with various imaging processes. The photosensitivity of the conventional laminate-type photoconductors is insufficient. Practical long use of the conventional laminate-type photoconductors causes charge potential lowering, residual potential rise, sensitivity lowering and such problems to be solved. Thus, a technology that facilitates realizing all the favorable properties for the electrophotographic photoconductor has not been established so far.

OBJECTS AND SUMMARY OF THE INVENTION

In view of the foregoing it is an object of the present invention to overcome the limitations of prior art.

It is another object of the invention to provide an electrophotographic photoconductor that is stable enough to endure repeated continuous use for extended practical use in electrophotographic apparatuses.

It is another object of the present invention to provide an electrophotographic photoconductor that can afford to be adaptable to various electrophotographic apparatuses which employ various known methods such as the corotron method or the scrotron method that uses metal wire for charging, which employ the contact charging method that uses the charging brush or charging roller for charging, which employ the two components-development method, which employ the nonmagnetic-single-component development method or which employ the magnetic-single-component development method.

It is still another object of the invention to provide a highly sensitive electrophotographic photoconductor that exhibits excellent electrical properties in the positive-charging mode. It is a further object of the invention to provide an electrophotographic photoconductor adaptable to copying machines and printers.

The present inventors have found that the foregoing problems are solved by the electrophotographic photoconductor that contains at least one charge transport agent selected from specific furan derivatives and thiophene derivatives in the photoconductive layer.

According to an aspect of the invention, there is provided an electrophotographic photoconductor that includes a conductive substrate; a photoconductive layer on the conductive substrate; the photoconductive layer containing at least one of charge transport agents comprising furan derivatives and thiophene derivatives which are described by the general formula (I) in FIG. 4(*a*), where A is a hydrogen atom, substituted or non-substituted alkyl group, or substituted or non-substituted aromatic group; $R^1$ is a hydrogen atom, halogen atom, substituted or non-substituted alkyl group, alkoxy group, alkylamino group, nitro group, cyano group, substituted or non-substituted aromatic group, or substituted or non-substituted heterocyclic group; $R^2$ is a hydrogen atom, halogen atom, substituted or non-substituted alkyl group, alkoxy group, alkylamino group, nitro group, cyano group, substituted or non-substituted aromatic group, or substituted or non-substituted heterocyclic group; $R^3$ is a hydrogen atom, halogen atom, substituted or non-substituted alkyl group, or substituted or non-substituted aromatic group; $R^4$ is a hydrogen atom, halogen atom, substituted or non-substituted alkyl group, or substituted or non-substituted aromatic group; $R^5$ is a cyano group, or alkoxycarbonyl group; $R^6$ is a cyano group, or alkoxycarbonyl group; and X is an oxygen atom or sulfur atom.

According to the present invention, substituents for substituted alkyls include halogen atoms; aryl groups such as, for example, phenyl groups; and heterocyclic groups, such as, for example, thienyl groups.

According to the present invention, substitutents for substituted heterocyclics include halogen atoms; alkyl groups, such as, for example, methyl groups and ethyl groups; aryl groups, such as, for example, phehnyl gorups; and heterocyclic groups, such as, for example, thienyl groups.

According to the present invention, substituents for substituted aromatics include halogen atoms; alkyl groups, such as, for example, methyl groups and ethyl groups; amino groups, such as, for example, dialkylamino groups; aryl groups, such as, for example, phenyl groups; and heterocyclic groups, such as, for example, thienyl groups.

According to another aspect of the invention, there is provided an electrophotographic photoconductor that includes a conductive substrate; a photoconductive layer on the conductive substrate; the photoconductive layer containing at least one of charge transport agents comprising furan derivatives and thiophene derivatives described by the general formula (II) in FIG. 4(*b*), where $R^{13}$ is a hydrogen atom, halogen atom, substituted or non-substituted alkyl group, substituted or non-substituted aromatic group, or substituted or non-substituted heterocyclic group; $R^{14}$ is a hydrogen atom, halogen atom, substituted or non-substituted alkyl group, substituted or non-substituted aromatic group, or substituted or non-substituted heterocyclic group; $R^{15}$ is a hydrogen atom, halogen atom, substituted or non-substituted alkyl group, substituted or non-substituted aromatic group, or substituted or non-substituted heterocyclic group; $R^{16}$ is a hydrogen atom, halogen atom, substituted or non-substituted alkyl group, substituted or non-substituted aromatic group, or substituted or non-substituted heterocyclic group; $R^{19}$ is a hydrogen atom, substituted or non-substituted alkyl group, or substituted or non-substituted aromatic group; $R^{20}$ is a hydrogen atom, substituted or non-substituted alkyl group, or substituted or non-substituted aromatic group; $R^{11}$ is a cyano group, or alkoxycarbonyl group; $R^{12}$ is a cyano group, or alkoxycarbonyl group; $R^{17}$ is a cyano group, or alkoxycarbonyl group; $R^{18}$ is a cyano group, or alkoxycarbonyl group; and X is an oxygen atom or sulfur atom.

According to the present invention, substituents for substituted alkyls include halogen atoms; aryl groups such as, for example, phenyl groups; and heterocyclic groups, such as, for example, thienyl groups.

According to the present invention, substitutents for substituted heterocyclics include halogen atoms; alkyl groups, such as, for example, methyl groups and ethyl groups; aryl groups, such as, for example, phenyl groups; and heterocyclic groups, such as, for example, thienyl groups.

According to the present invention, substituents for substituted aromatics include halogen atoms; alkyl groups, such as, for example, methyl groups and ethyl groups; amino groups, such as, for example, dialkylamino groups; aryl groups, such as, for example, phenyl groups; and heterocyclic groups, such as, for example, thienyl groups.

Advantageously, $R^{19}$ and $R^{20}$ in the general formula (II) form a ring.

The furan derivatives and the thiophene derivatives described by the general formulas (I) and (II) have not been used for the electrophotographic photoconductor. The present inventors have investigated application of such furan derivatives and thiophene derivatives described by the general formulas (I) and (II) and discovered their advantageous use.

The photoconductor according to the invention exhibits high sensitivity. Further, the electrical potential characteristics and sensitivity characteristics of the photoconductor of the invention are not deteriorated by the long term use in various electrophotographic apparatuses provided with the foregoing various imaging processes. That is, excellent electrophotographic properties are realized by adding the furan derivatives or the thiophene derivatives described by the general formula (I) or (II) to the photoconductive layer.

By using at least one of the furan derivatives or the thiophene derivatives as the charge transport agent, a highly sensitive and electrically excellent photoconductor that can be used in the positive-charging mode is obtained.

Briefly stated, an electrophotographic photoconductor contains at least a furan derivative or a thiophene derivative as the charge transport agent in a photoconductive layer thereof.

According to an embodiment of the present invention, a charge transport compound in a photoconductive layer, wherein the charge transport compound is a furan derivative or a thiophene derivative, wherein the charge transport compound is described by a general formula (I):

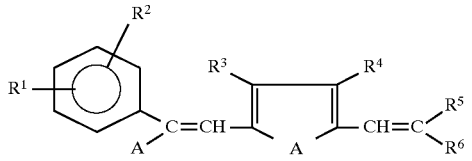

(I)

A being a hydrogen atom, substituted or non-substituted alkyl group, or substituted or non-substituted aromatic group;

$R^1$ being a hydrogen atom, halogen atom, substituted or non-substituted alkyl group, alkoxy group, alkylamino group, nitro group, cyano group, substituted or non-substituted aromatic group, or substituted or non-substituted heterocyclic group;

$R^2$ being a hydrogen atom, halogen atom, substituted or non-substituted alkyl group, alkoxy group, alkylamino group, nitro group, cyano group, substituted or non-substituted aromatic group, or substituted or non-substituted heterocyclic group;

$R^3$ being a hydrogen atom, halogen atom, substituted or non-substituted alkyl group, or substituted or non-substituted aromatic group;

$R^4$ being a hydrogen atom, halogen atom, substituted or non-substituted alkyl group, or substituted or non-substituted aromatic group;

$R^5$ being a cyano group, or alkoxycarbonyl group;

$R^6$ being a cyano group, or alkoxycarbonyl group; and

X being an oxygen atom or sulfur atom.

According to another embodiment of the present invention, an electrophotographic photoconductor comprises a conductive substrate, a photoconductive layer on the conductive substrate, the photoconductive layer comprising at least one charge transport agent, the charge transport agent comprising at least one furan derivative or thiophene derivative, the furan derivative and thiophene derivative being described by the following general formula (I):

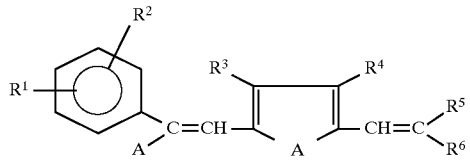

(I)

A being a hydrogen atom, substituted or non-substituted alkyl group, or substituted or non-substituted aromatic group;

$R^1$ being a hydrogen atom, halogen atom, substituted or non-substituted alkyl group, alkoxy group, alkylamino group, nitro group, cyano group, substituted or non-substituted aromatic group, or substituted or non-substituted heterocyclic group;

$R^2$ being a hydrogen atom, halogen atom, substituted or non-substituted alkyl group, alkoxy group, alkylamino group, nitro group, cyano group, substituted or non-substituted aromatic group, or substituted or non-substituted heterocyclic group;

$R^3$ being a hydrogen atom, halogen atom, substituted or non-substituted alkyl group, or substituted or non-substituted aromatic group;

$R^4$ being a hydrogen atom, halogen atom, substituted or non-substituted alkyl group, or substituted or non-substituted aromatic group;

$R^5$ being a cyano group, or alkoxycarbonyl group;

$R^6$ being a cyano group, or alkoxycarbonyl group; and

X being an oxygen atom or sulfur atom.

According to an embodiment of the present invention, a method to make a photosensitive body by forming a photosensitive layer on a substrate, the photosensitive layer includes a charge transport compound wherein the charge transport compound is a furan derivative or thiophene derivative described by a general formula (I):

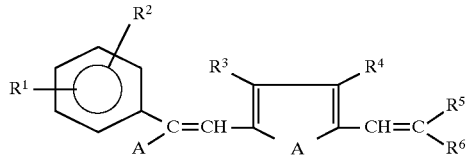

(I)

A being a hydrogen atom, substituted or non-substituted alkyl group, or substituted or non-substituted aromatic group;

$R^1$ being a hydrogen atom, halogen atom, substituted or non-substituted alkyl group, alkoxy group, alkylamino group, nitro group, cyano group, substituted or non-substituted aromatic group, or substituted or non-substituted heterocyclic group;

$R^2$ being a hydrogen atom, halogen atom, substituted or non-substituted alkyl group, alkoxy group, alkylamino group, nitro group, cyano group, substituted or non-substituted aromatic group, or substituted or non-substituted heterocyclic group;

$R^3$ being a hydrogen atom, halogen atom, substituted or non-substituted alkyl group, or substituted or non-substituted aromatic group;

$R^4$ being a hydrogen atom, halogen atom, substituted or non-substituted alkyl group, or substituted or non-substituted aromatic group;

$R^5$ being a cyano group, or alkoxycarbonyl group;

$R^6$ being a cyano group, or alkoxycarbonyl group; and

X being an oxygen atom or sulfur atom.

According to another embodiment of the present invention, a charge transport compound in a photoconductive layer, wherein the charge transport compound is a furan derivative or thiophene derivative described by a general formula (II):

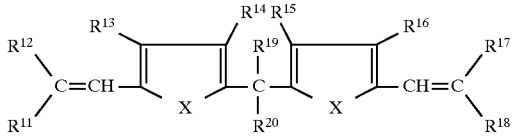

(II)

$R^{13}$ being a hydrogen atom, halogen atom, substituted or non-substituted alkyl group, substituted or non-substituted aromatic group, or substituted or non-substituted heterocyclic group;

$R^{14}$ being a hydrogen atom, halogen atom, substituted or non-substituted alkyl group, substituted or non-substituted aromatic group, or substituted or non-substituted heterocyclic group;

$R^{15}$ being a hydrogen atom, halogen atom, substituted or non-substituted alkyl group, substituted or non-substituted aromatic group, or substituted or non-substituted heterocyclic group;

$R^{16}$ being a hydrogen atom, halogen atom, substituted or non-substituted alkyl group, substituted or non-substituted aromatic group, or substituted or non-substituted heterocyclic group;

$R^{19}$ being a hydrogen atom, substituted or non-substituted alkyl group, or substituted or non-substituted aromatic group;

$R^{20}$ being a hydrogen atom, substituted or non-substituted alkyl group, or substituted or non-substituted aromatic group;

$R^{11}$ being a cyano group, or alkoxycarbonyl group;

$R^{12}$ being a cyano group, or alkoxycarbonyl group;

$R^{17}$ being a cyano group, or alkoxycarbonyl group;

$R^{18}$ being a cyano group, or alkoxycarbonyl group; and

X being an oxygen atom or sulfur atom.

According to an embodiment of the present invention, a charge transport compound above, wherein the $R^{19}$ and $R^{20}$ form a ring.

According to another embodiment of the present invention, an electrophotographic photoconductor comprises a conductive substrate, a photoconductive layer on the conductive substrate, the photoconductive layer comprising at least one of charge transport agents, the charge transport agents comprising furan derivatives and thiophene derivatives, the furan derivatives and thiophene derivatives being described by the following general formula (II):

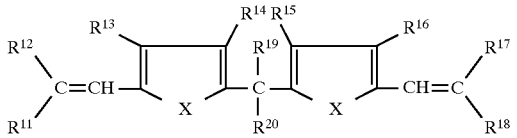

(II)

$R^{13}$ being a hydrogen atom, halogen atom, substituted or non-substituted alkyl group, substituted or non-substituted aromatic group, or substituted or non-substituted heterocyclic group;

$R^{14}$ being a hydrogen atom, halogen atom, substituted or non-substituted alkyl group, substituted or non-substituted aromatic group, or substituted or non-substituted heterocyclic group;

$R^{15}$ being a hydrogen atom, halogen atom, substituted or non-substituted alkyl group, substituted or non-substituted aromatic group, or substituted or non-substituted heterocyclic group;

$R^{16}$ being a hydrogen atom, halogen atom, substituted or non-substituted alkyl group, substituted or non-substituted aromatic group, or substituted or non-substituted heterocyclic group;

$R^{19}$ being a hydrogen atom, substituted or non-substituted alkyl group, or substituted or non-substituted aromatic group;

$R^{20}$ being a hydrogen atom, substituted or non-substituted alkyl group, or substituted or non-substituted aromatic group;

$R^{11}$ being a cyano group, or alkoxycarbonyl group;

$R^{12}$ being a cyano group, or alkoxycarbonyl group;

$R^{17}$ being a cyano group, or alkoxycarbonyl group;

$R^{18}$ being a cyano group, or alkoxycarbonyl group; and

X being an oxygen atom or sulfur atom.

According to an embodiment of the present invention, an electrophotographic photoconductor above, wherein the $R^{19}$ and $R^{20}$ form a ring.

According to another embodiment of the present invention, a method to make a photosensitive body by forming a photosensitive layer on a substrate, the photosensitive layer includes a charge transport compound wherein the charge transport compound is a furan derivative or thiophene derivative described by a general formula (II):

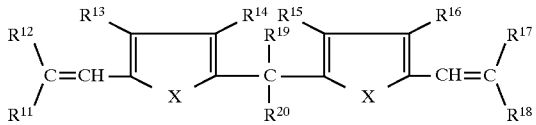

(II)

$R^{13}$ being a hydrogen atom, halogen atom, substituted or non-substituted alkyl group, substituted or non-substituted aromatic group, or substituted or non-substituted heterocyclic group;

$R^{14}$ being a hydrogen atom, halogen atom, substituted or non-substituted alkyl group, substituted or non-substituted aromatic group, or substituted or non-substituted heterocyclic group;

$R^{15}$ being a hydrogen atom, halogen atom, substituted or non-substituted alkyl group, substituted or non-substituted aromatic group, or substituted or non-substituted heterocyclic group;

$R^{16}$ being a hydrogen atom, halogen atom, substituted or non-substituted alkyl group, substituted or non-substituted aromatic group, or substituted or non-substituted heterocyclic group;

$R^{19}$ being a hydrogen atom, substituted or non-substituted alkyl group, or substituted or non-substituted aromatic group;

$R^{20}$ being a hydrogen atom, substituted or non-substituted alkyl group, or substituted or non-substituted aromatic group;

$R^{11}$ being a cyano group, or alkoxycarbonyl group;

$R^{12}$ being a cyano group, or alkoxycarbonyl group;

$R^{17}$ being a cyano group, or alkoxycarbonyl group;

$R^{18}$ being a cyano group, or alkoxycarbonyl group; and

X being an oxygen atom or sulfur atom.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 4(*b*) describes another general formula (II) of the furan derivatives and thiophene derivatives for the charge transport agent.

FIG. 5(*b*) describes structural formulas of the other starting reagents for synthesizing the compounds described by the general formulas (I) and (II) in FIGS. 4(*a*) and 4(*b*).

FIGS. 8(*b*) through 8(*d*) describe the azo compounds including the derivatives thereof as the charge generation agents used in the invention.

DETAILED DESCRIPTION OF THE PREFERRED EMBODIMENT

Figure 4A:
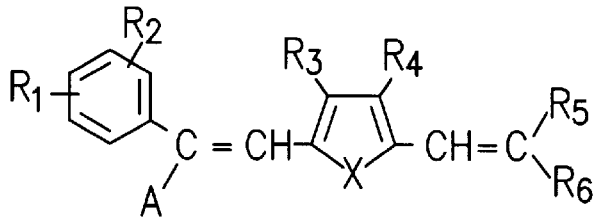
FIG. 4(*a*) describes a general formula (I) of the furan derivatives and thiophene derivatives for the charge transport agent.
Figure 4B:
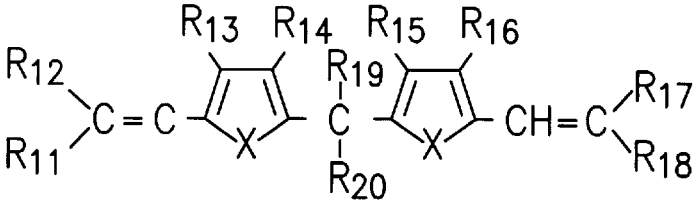

According to the present invention, an electrophotographic photoconductor includes a conductive substrate; a photoconductive layer on the conductive substrate; the photoconductive layer containing at least one of charge transport agents comprising furan derivatives and thiophene derivatives which are described by the general formula (I) in FIG. 4(*a*), where A is a hydrogen atom, substituted or non-substituted alkyl group, or substituted or non-substituted aromatic group; $R^1$ is a hydrogen atom, halogen atom, substituted or non-substituted alkyl group, alkoxy group, alkylamino group, nitro group, cyano group, substituted or non-substituted aromatic group, or substituted or non-substituted heterocyclic group; $R^2$ is a hydrogen atom, halogen atom, substituted or non-substituted alkyl group, alkoxy group, alkylamino group, nitro group, cyano group, substituted or non-substituted aromatic group, or substituted or non-substituted heterocyclic group; $R^3$ is a hydrogen atom, halogen atom, substituted or non-substituted alkyl group, or substituted or non-substituted aromatic group; $R^4$ is a hydrogen atom, halogen atom, substituted or non-substituted alkyl group, or substituted or non-substituted aromatic group; $R^5$ is a cyano group, or alkoxycarbonyl group; $R^6$ is a cyano group, or alkoxycarbonyl group; and X is an oxygen atom or sulfur atom.

Preferably, A in the general formula (I) is a hydrogen atom, alkyl group containing from one to eight carbon atom or atoms, non-substituted phenyl group, non-substituted biphenyl group, non-substituted naphthyl group, phenyl group substituted by one or more halogen atom or atoms, phenyl group substituted by an alkyl group containing from one to eight carbon atom or atoms, or phenyl group substituted by an alkylamino group containing from one to eight carbon atom or atoms.

Preferably, the alkyl group, alkoxy group and alkylamino group for $R^1$ and $R^2$ in the general formula (I) contain from one to eight carbon atom or atoms.

According to another embodiment of the present invention, there is provided an electrophotographic photoconductor that includes a conductive substrate; a photoconductive layer on the conductive substrate; the photoconductive layer containing at least one of charge transport agents comprising furan derivatives and thiophene derivatives described by the general formula (II) in FIG. 4(*b*), where $R^{13}$ is a hydrogen atom, halogen atom, substituted or non-substituted alkyl group, substituted or non-substituted aromatic group, or substituted or non-substituted heterocyclic group; $R^{14}$ is a hydrogen atom, halogen atom, substituted or non-substituted alkyl group, substituted or non-substituted aromatic group, or substituted or non-substituted heterocyclic group; $R^{15}$ is a hydrogen atom, halogen atom, substituted or non-substituted alkyl group, substituted or non-substituted aromatic group, or substituted or non-substituted heterocyclic group; $R^{16}$ is a hydrogen atom, halogen atom, substituted or non-substituted alkyl group, substituted or non-substituted aromatic group, or substituted or non-substituted heterocyclic group; $R^{19}$ is a hydrogen atom, substituted or non-substituted alkyl group, or substituted or non-substituted aromatic group; $R^{20}$ is a hydrogen atom, substituted or nonsubstituted alkyl group, or substituted or non-substituted aromatic group; $R^{11}$ is a cyano group, or alkoxycarbonyl group; $R^{12}$ is a cyano group, or alkoxycarbonyl group; $R^{17}$ is a cyano group, or alkoxycarbonyl group; $R^{18}$ is a cyano group, or alkoxycarbonyl group; and X is an oxygen atom or sulfur atom.

Advantageously, $R^{19}$ and $R^{20}$ in the general formula (II) form a ring.

Preferably, the alkyl group, alkoxy group and alkylamino group for $R^{13}$ through $R^{16}$ in the general formula (II) contain from one to eight carbon atom or atoms.

Figure 5A:
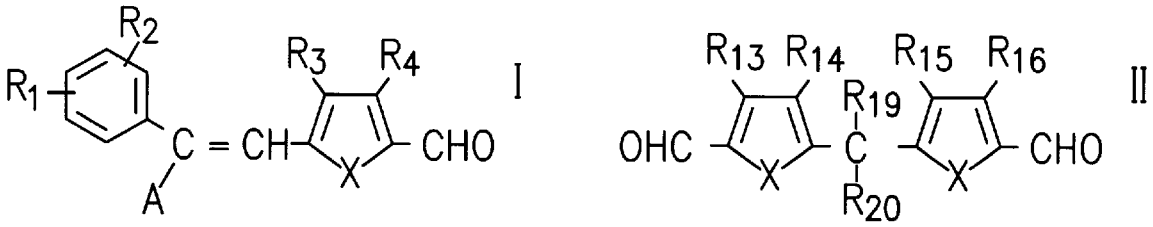
FIG. 5(*a*) describes structural formulas of the aldehyde compounds as the starting material for synthesizing the compounds described by the general formulas (I) and (II) in FIGS. 4(*a*) and 4(*b*).
Figure 5B:
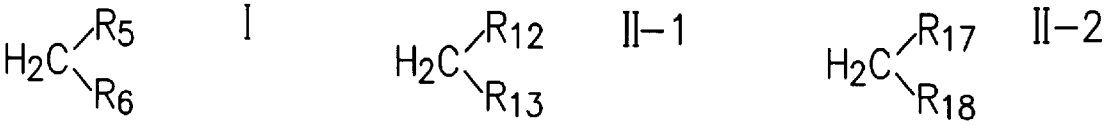
Figure 6A:
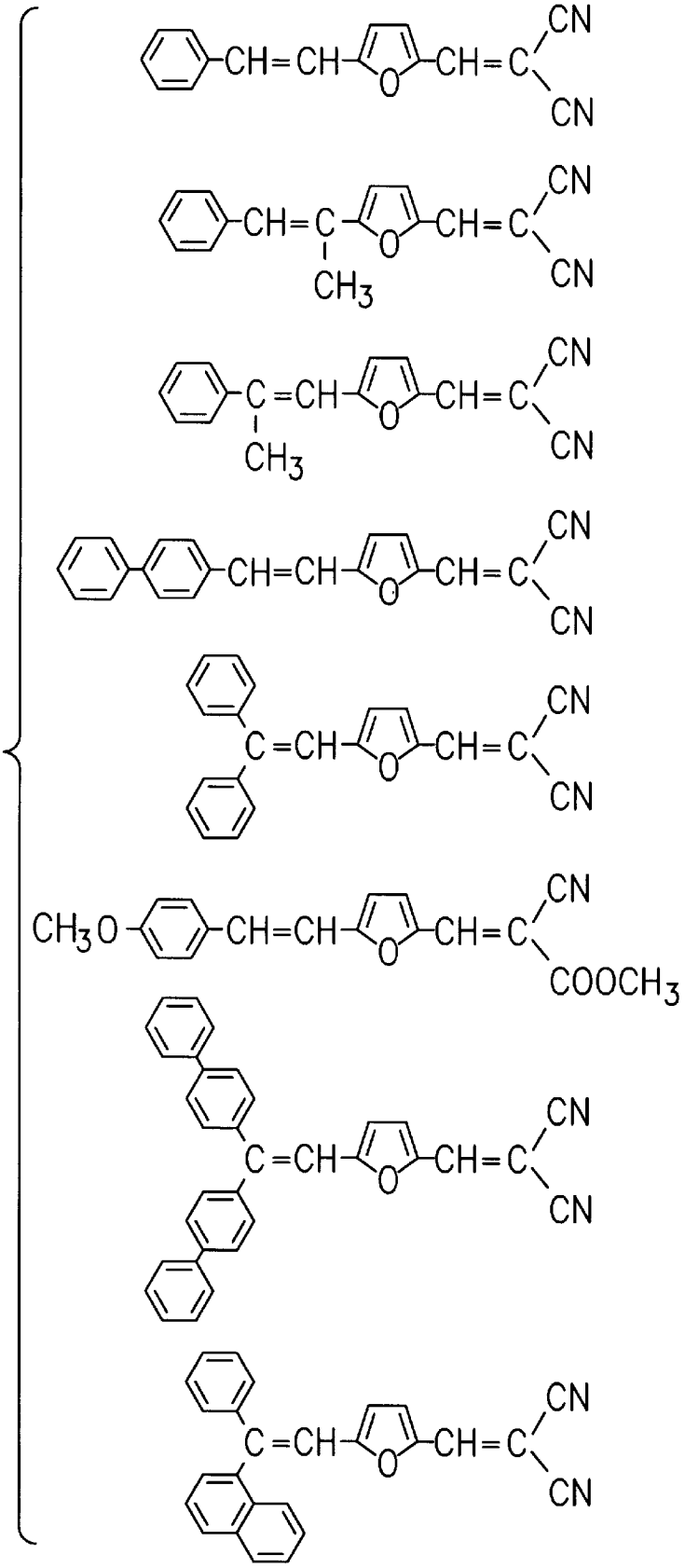
FIGS. 6(*a*) through 6(*c*) describe the examples of the furan derivatives and the thiophene derivatives represented by the general formula (I).
Figure 6B:
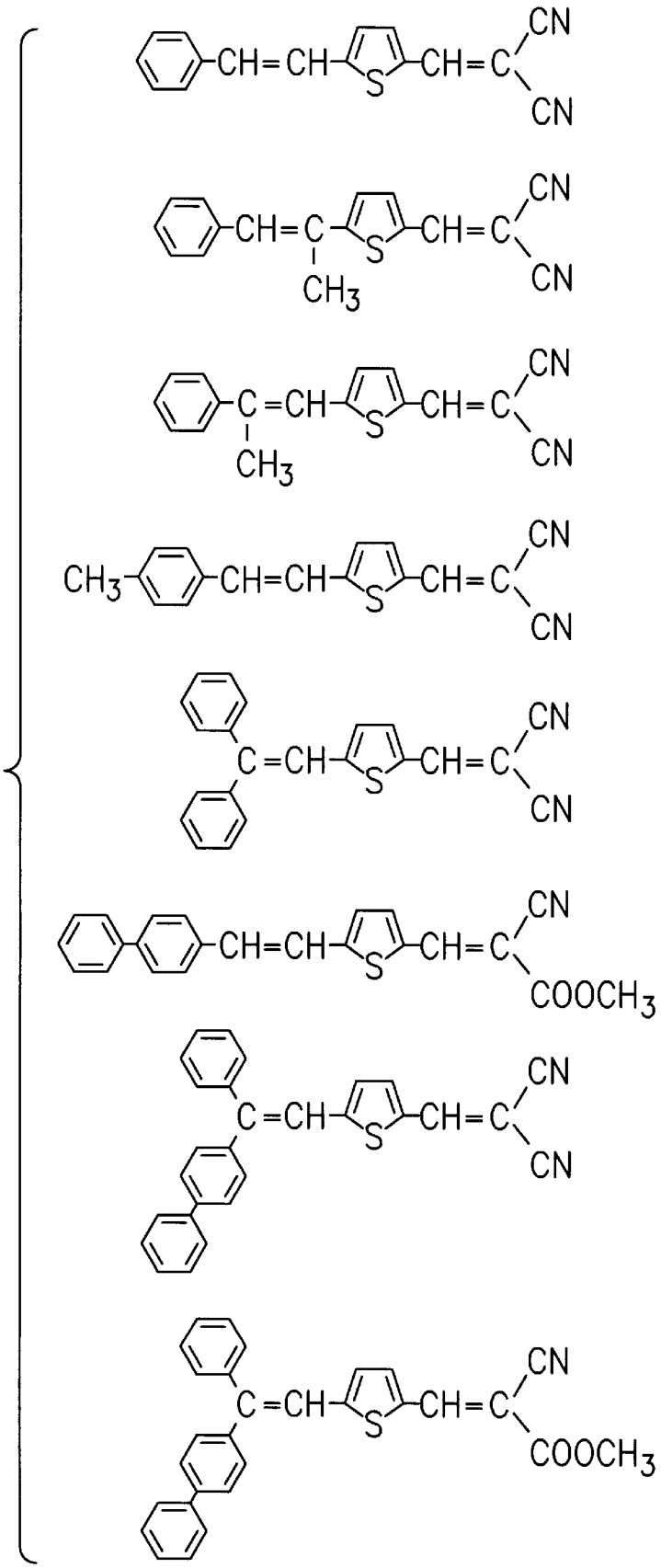
Figure 6C:
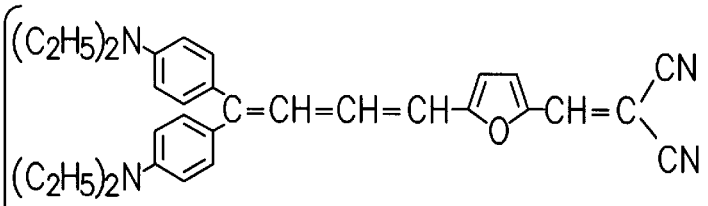
Figure 6C:
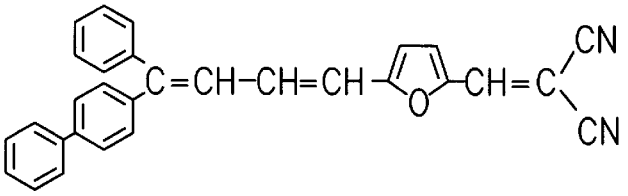
Figure 6C:
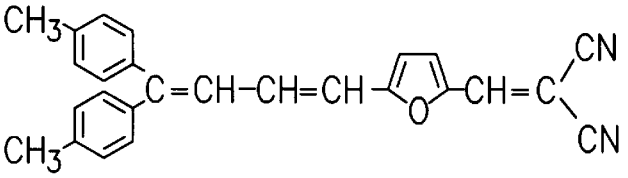
Figure 6C:
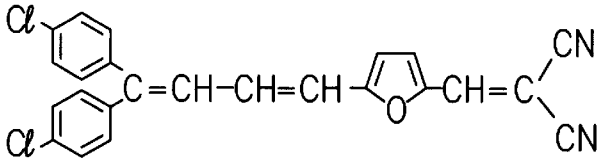
Figure 6C:
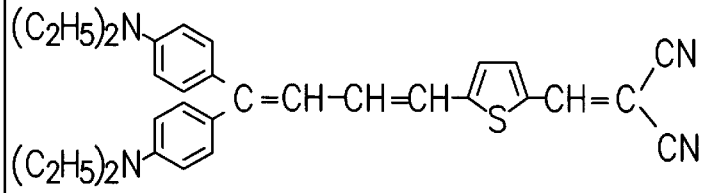
Figure 6C:
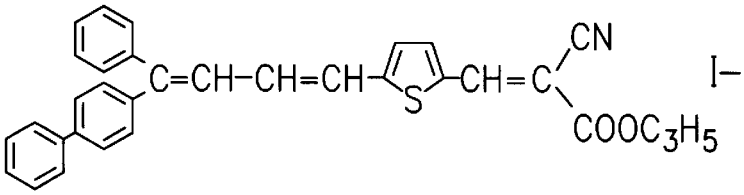
Figure 6C:
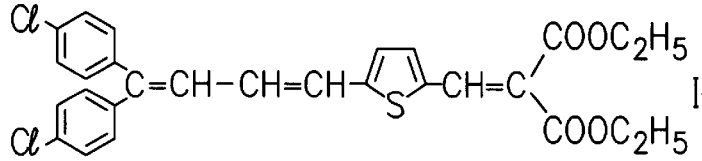
Figure 6C:
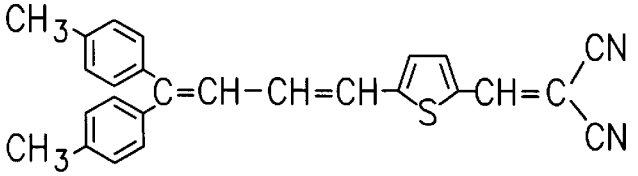
Figure 7A:
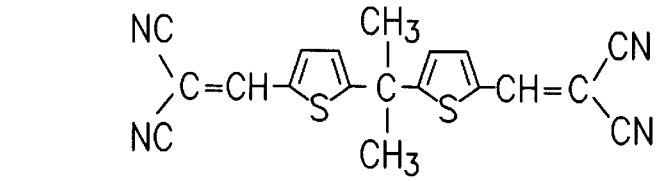
FIGS. 7(*a*) and 7(*b*) describe the examples of the furan derivatives and the thiophene derivatives represented by the general formula (II).
Figure 7A:
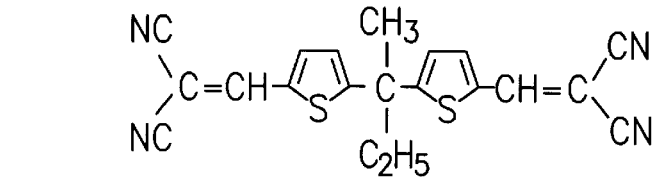
Figure 7A:
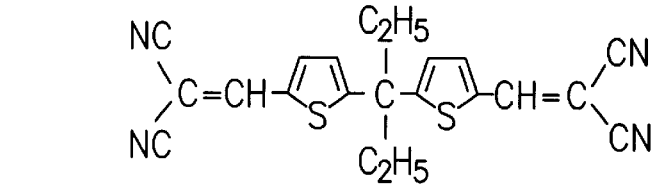
Figure 7A:
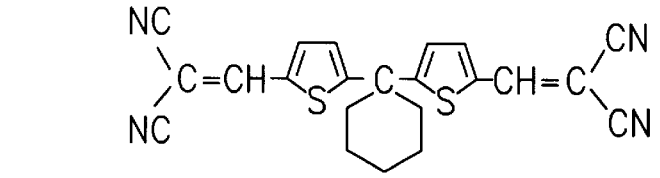
Figure 7A:
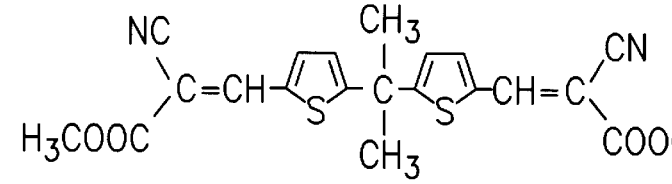
Figure 7A:
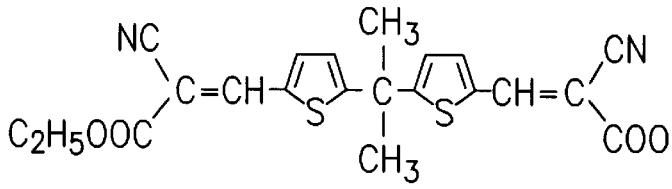
Figure 7B:
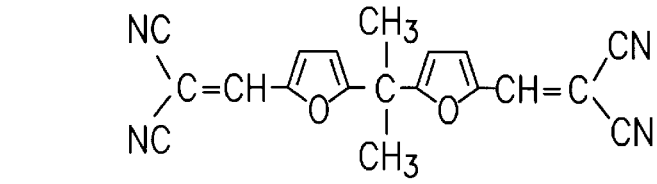
Figure 7B:
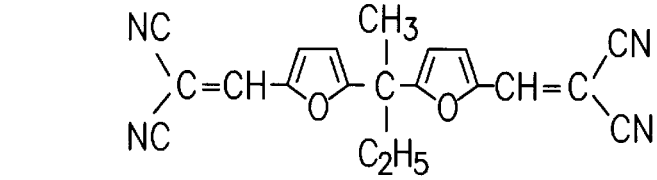
Figure 7B:
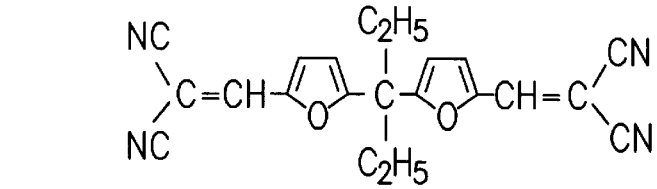
Figure 7B:
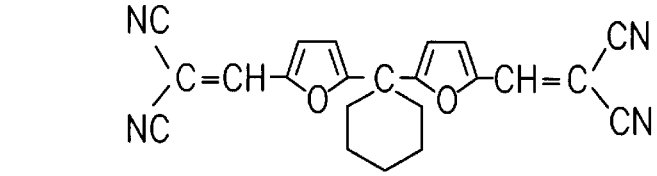
Figure 7B:
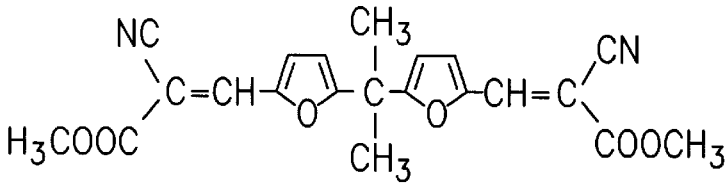
Figure 7B:
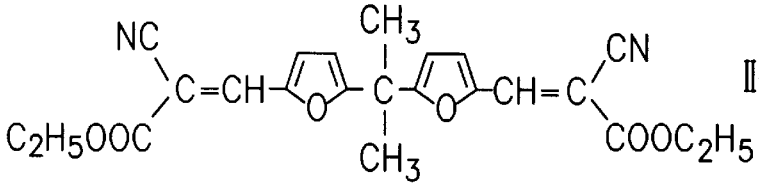
Figure 8A:
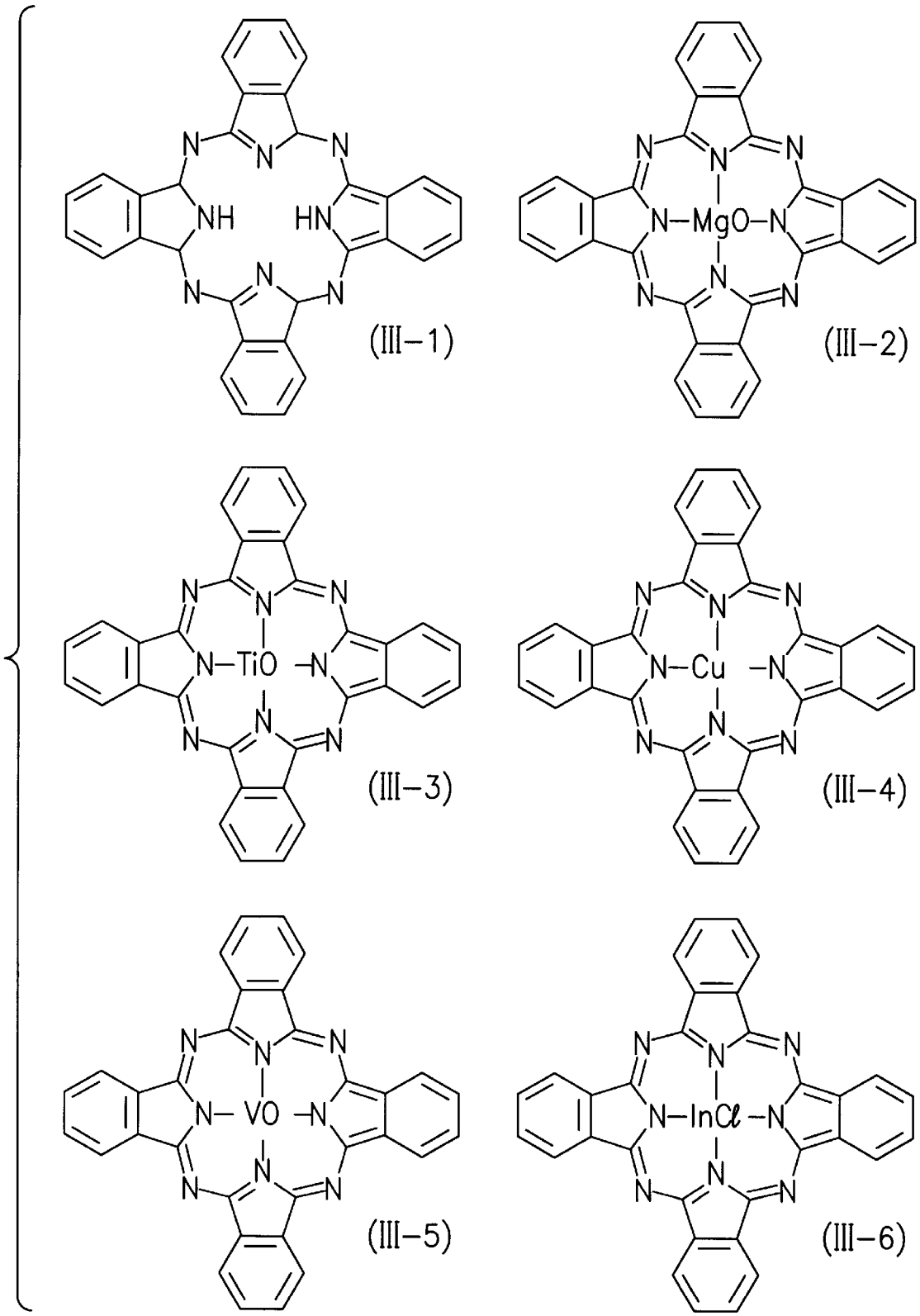
FIG. 8(*a*) describes phthalocyanine charge generation agents used in the invention.
Figure 8B:
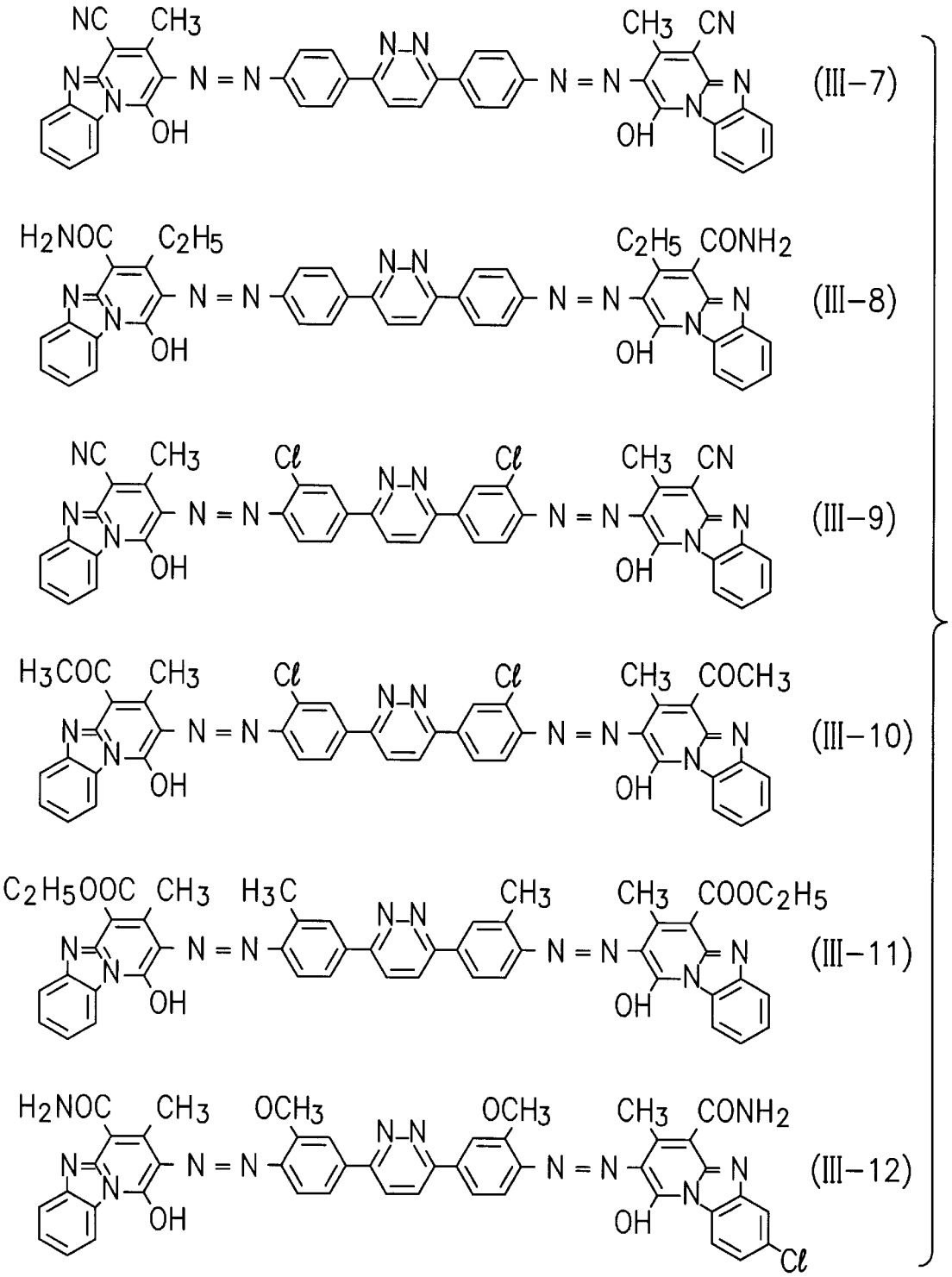
Figure 8C:
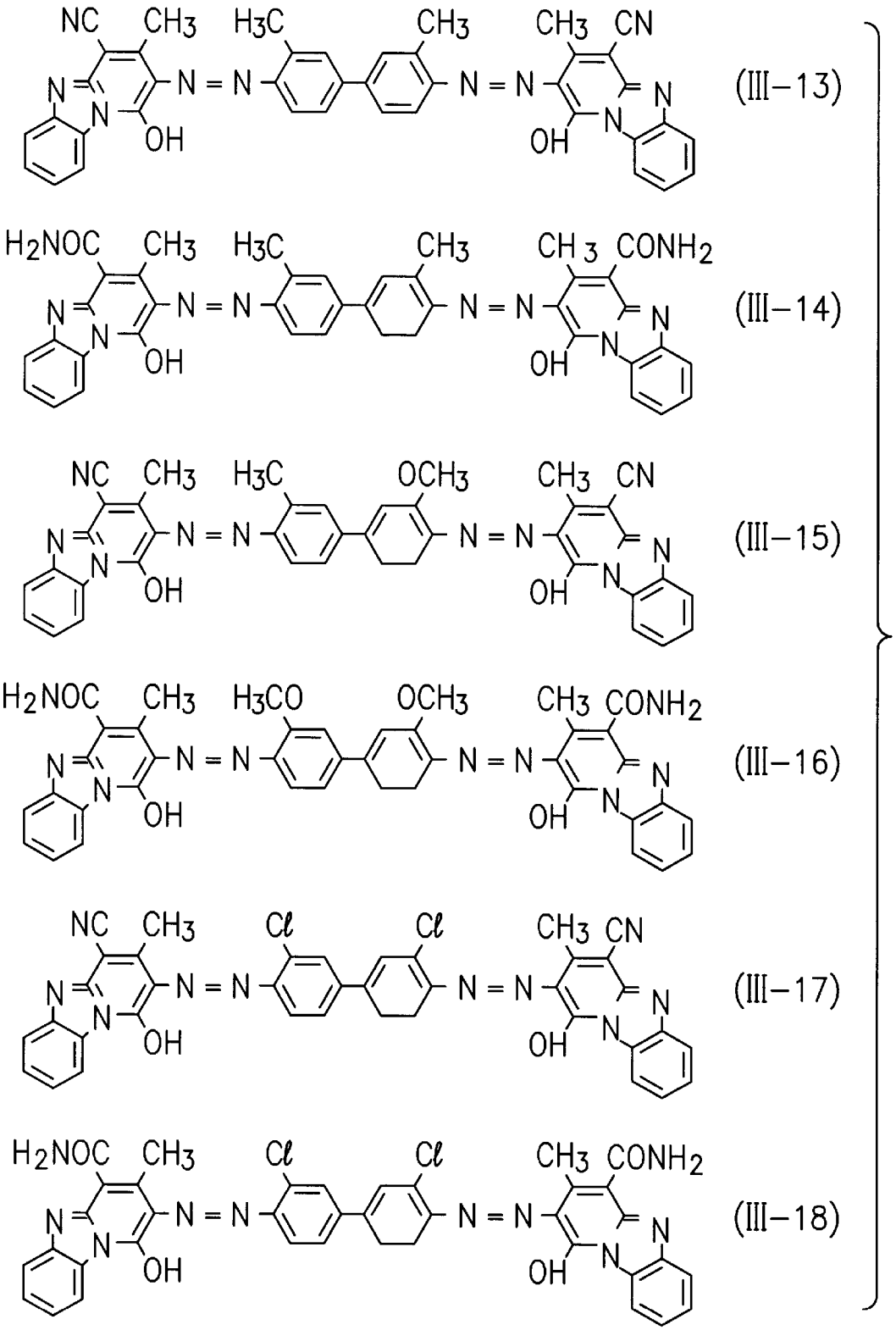
Figure 8D:
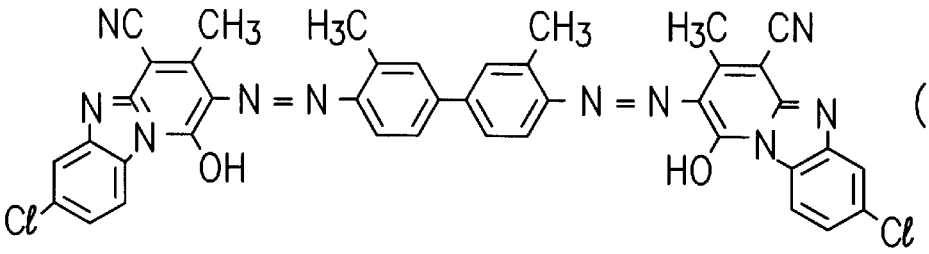
Figure 8D:
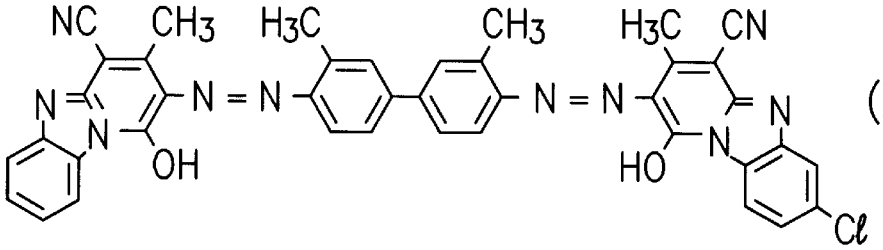
Figure 8D:
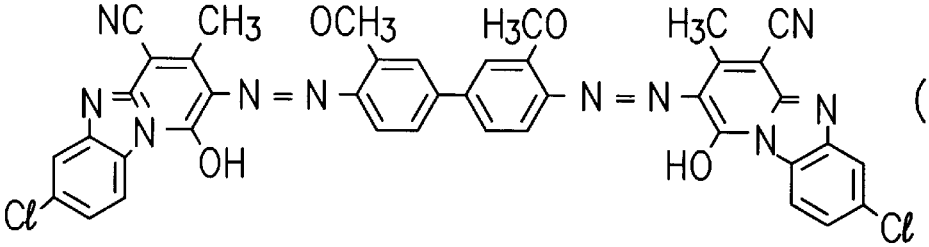
Figure 8D:
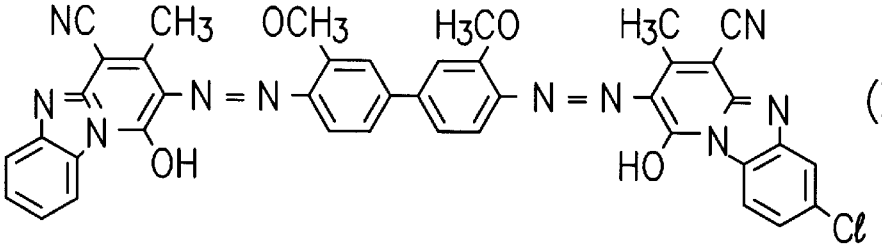
Figure 8D:
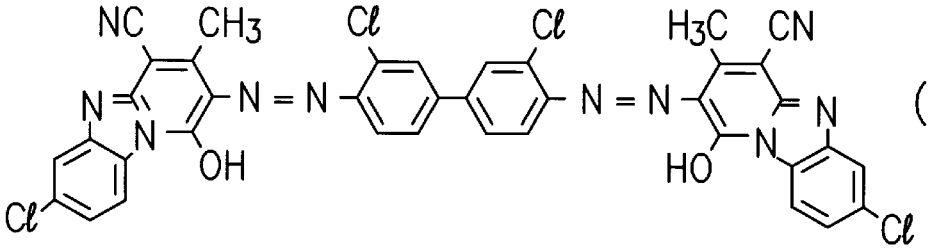
Figure 8D:
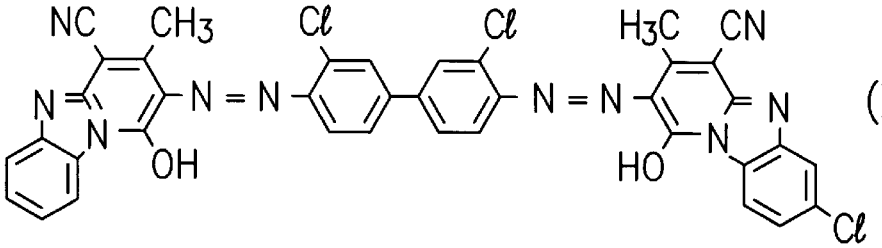

The furan derivatives and the thiophene derivatives described by the general formulas (I) and (II) are synthesized by conventionally known methods. The compounds described by the general formula (I) are easily synthesized by, for example, reacting the aldehyde compound described by the structural formula (I*a*) in FIG. 5(*a*) and the reagent described by the structural formula (I*b*) in FIG. 5(*b*) in an appropriate organic solvent, such as benzene and toluene, under alkaline presence. The compounds described by the general formula (II) are prepared easily by, for example, reacting the aldehyde described by the structural formula (II*a*) in FIG. 5(*a*) and the reagent described by the structural formula (II*b*) in FIG. 5(*b*) in an appropriate organic solvent, such as benzene and toluene, under alkaline presence.

Examples of the furan derivatives and the thiophene derivatives represented by the general formula (I) are described in FIGS. 6(*a*) through 6(*c*). Further, examples of the furan derivatives and the thiophene derivatives represented by the general formula (II) are described in FIGS. 7(*a*) and 7(*b*).

Figure 9A:
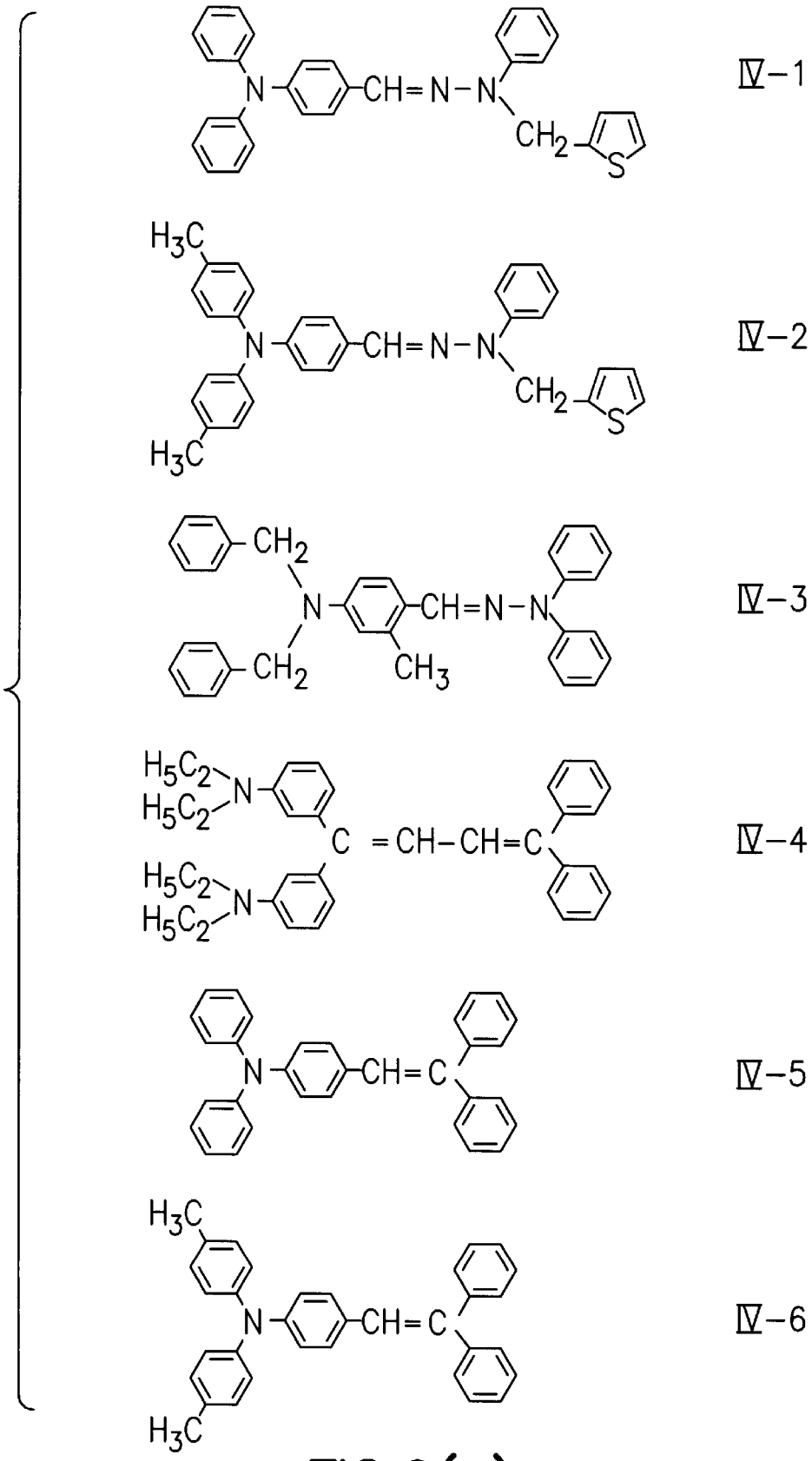
FIGS. 9(*a*) and 9(*b*) describe the compounds used in combination with the furan derivatives and the thiophene derivatives described by the general formulas (I) and (II).
Figure 9B:
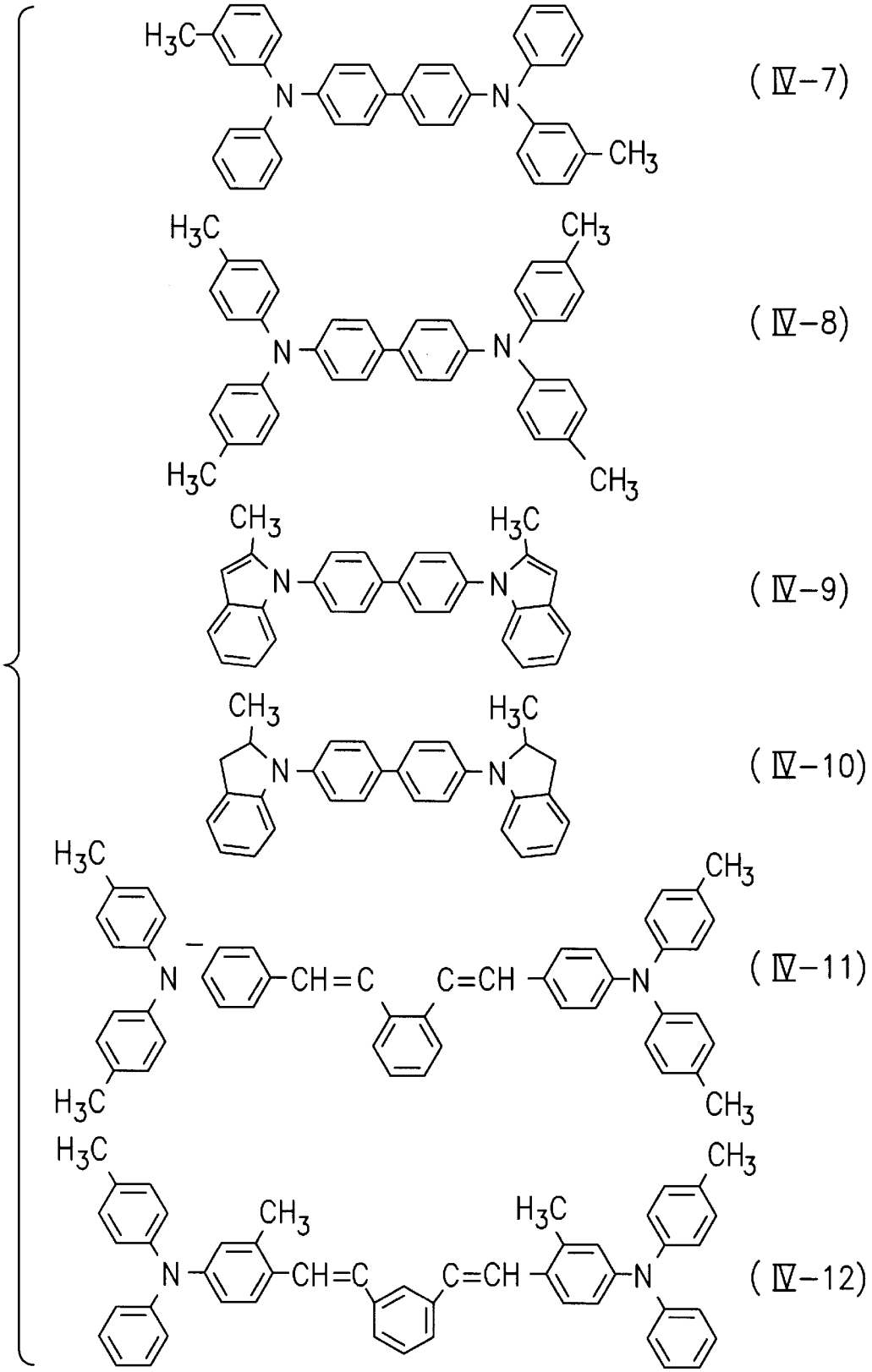

Examples of the charge generation agent used in the present invention include phthalocyanine compounds (III-1) through (III-6) described in FIG. 8(*a*), and azo compounds including the derivatives thereof (III-7) through (III-24) described in FIGS. 8(*b*) through 8(*d*). Various compounds (IV-1) through (IV-12) described in FIGS. 9(*a*) and 9(*b*) may be used in combination with the furan derivatives and the thiophene derivatives described by the general formulas (I) and (II).

Figure 10:
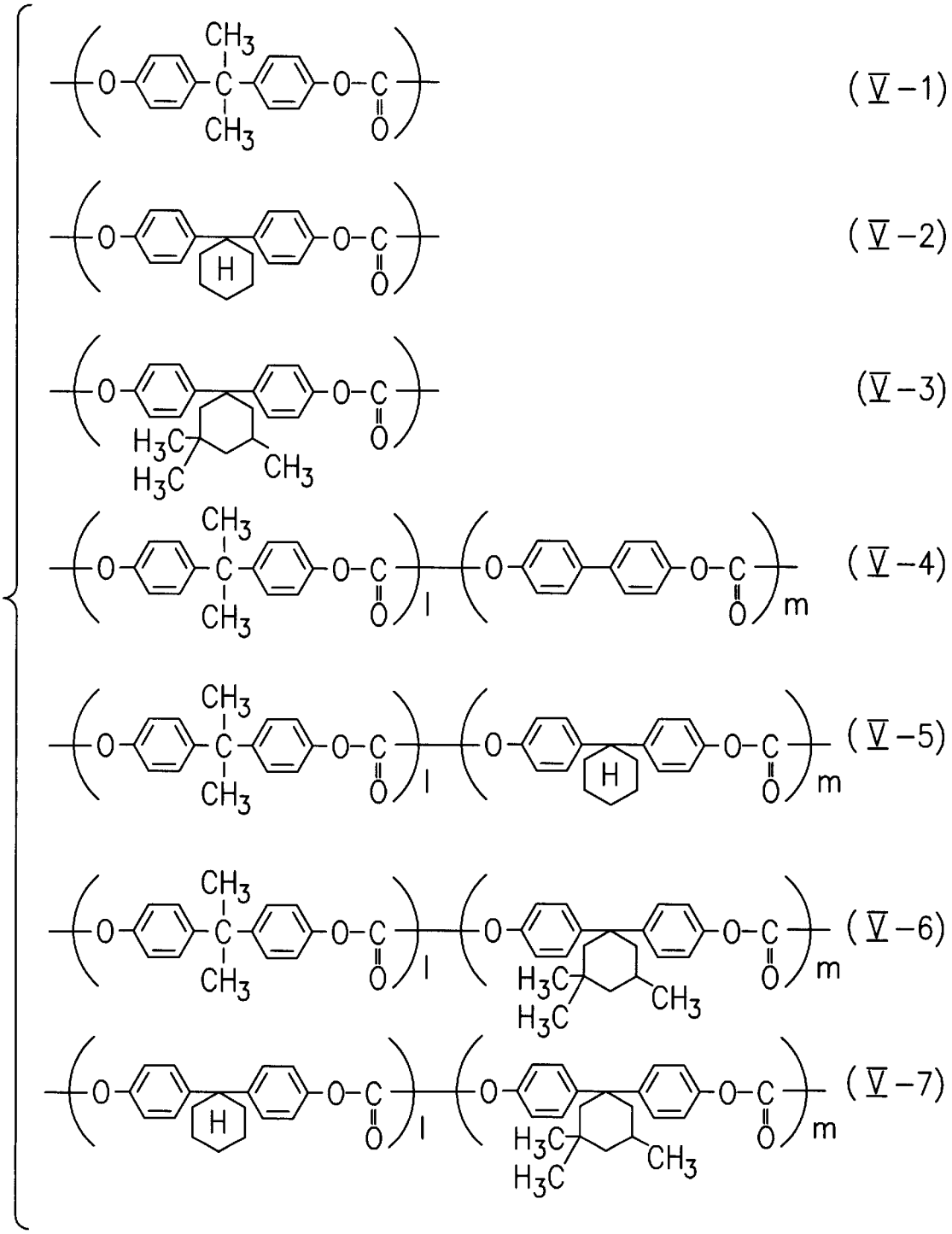
FIG. 10 describes the examples of the resin binder for the charge transport layer of the photoconductor of the invention.
Figure 11A:
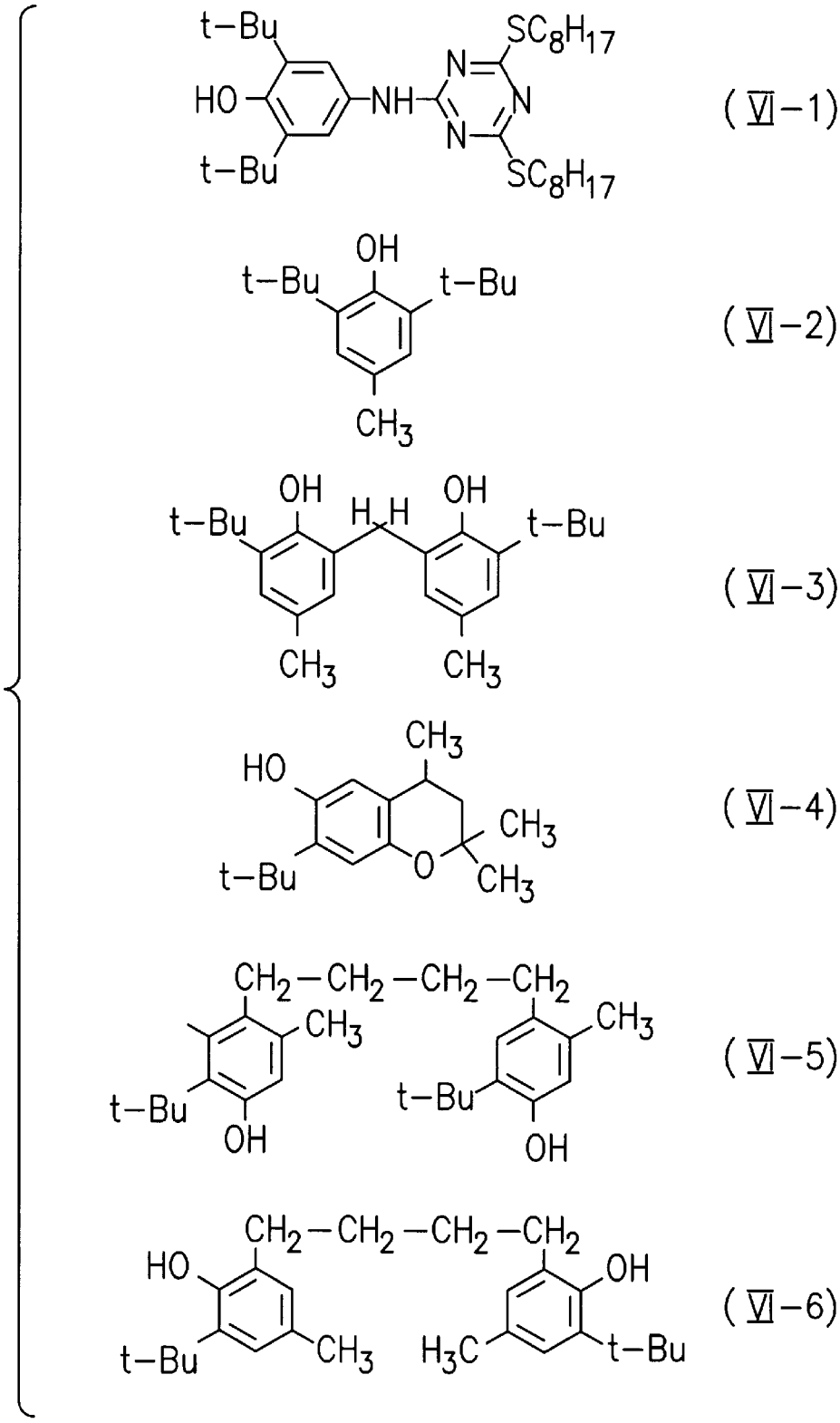
FIGS. 11(*a*) through 11(*f*) describe the antioxidants used in the photoconductive layer of the invention.
Figure 11B:
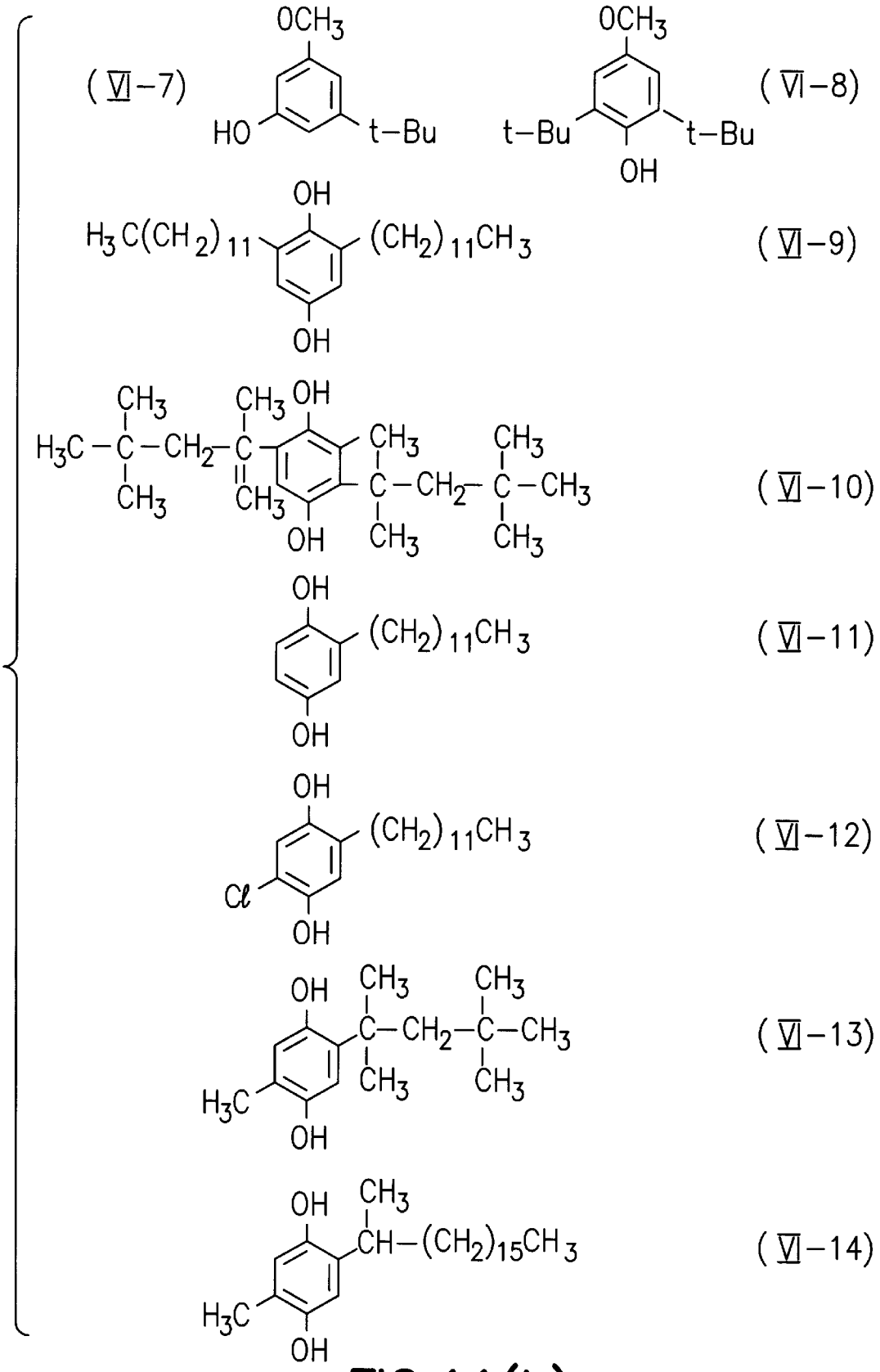
Figure 11C:
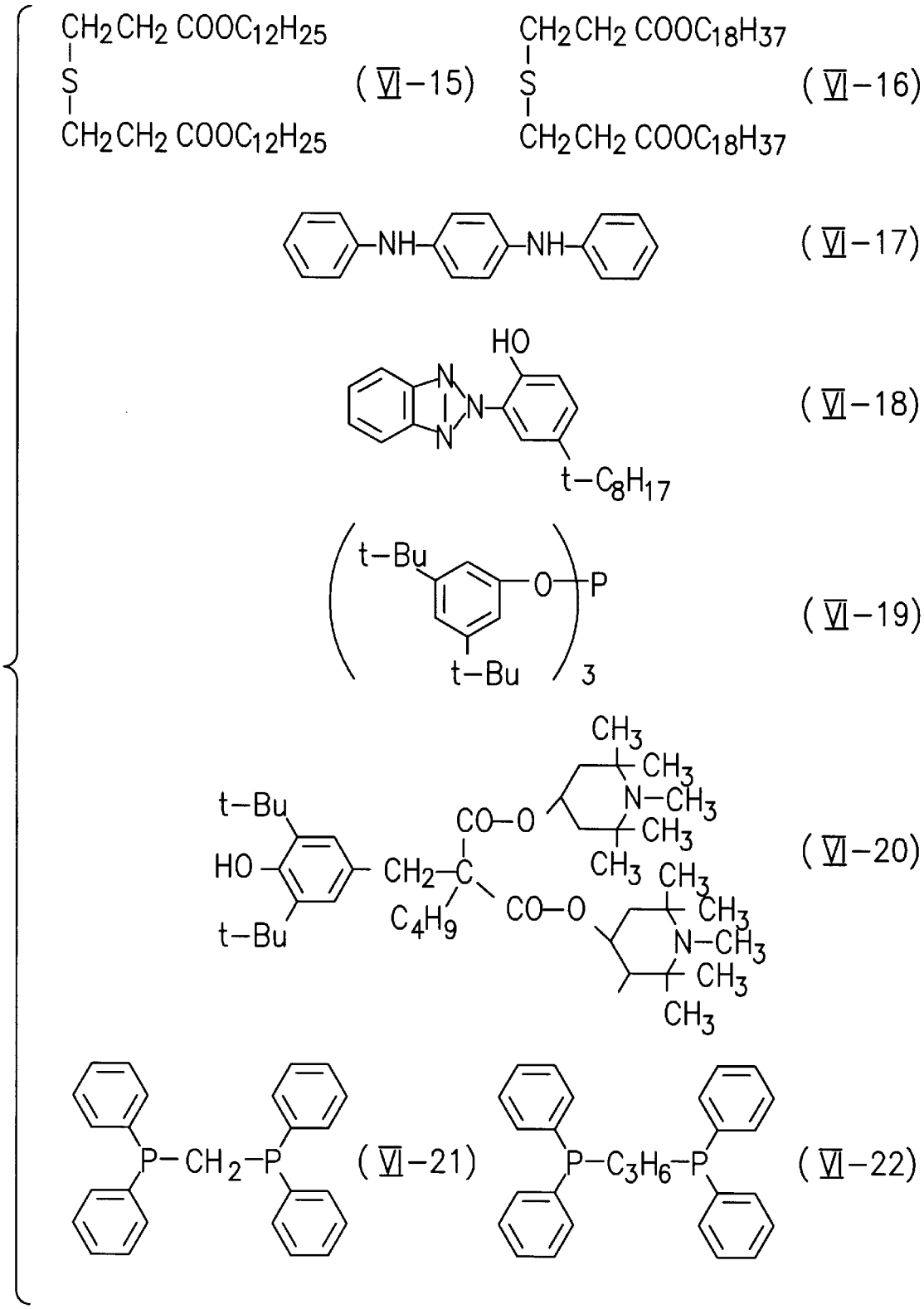
Figure 11D:
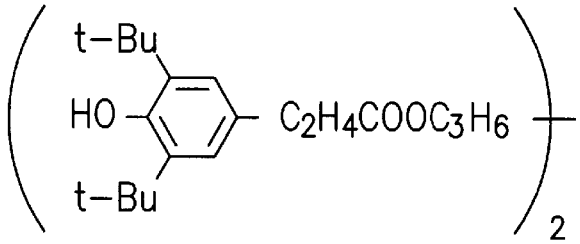
Figure 11D:
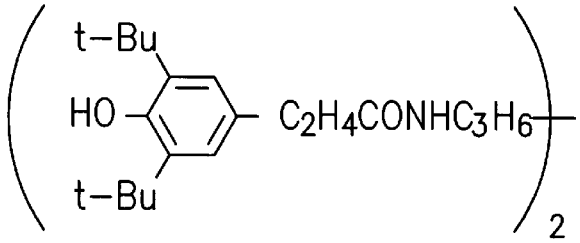
Figure 11D:
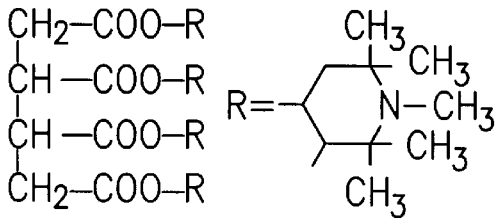
Figure 11D:
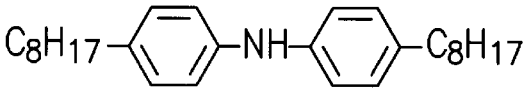
Figure 11D:
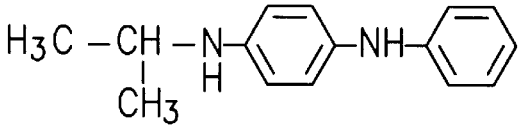
Figure 11D:
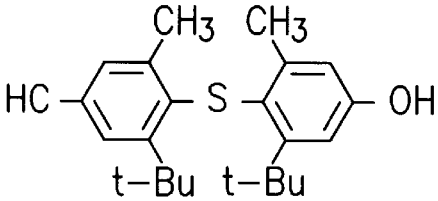
Figure 11D:
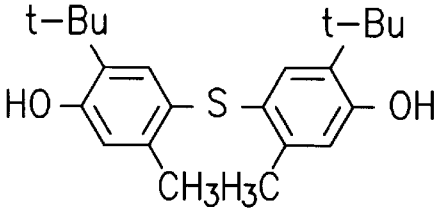
Figure 11E:
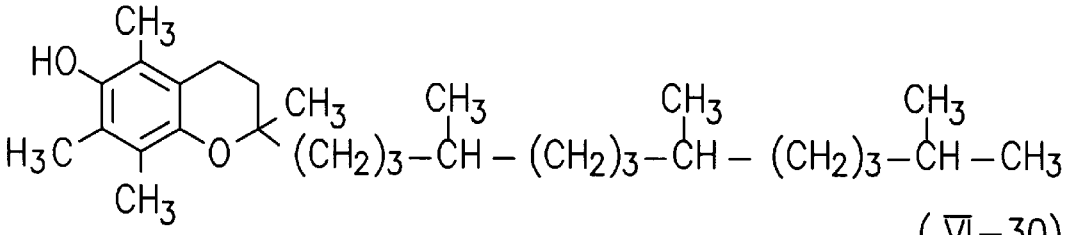
Figure 11E:
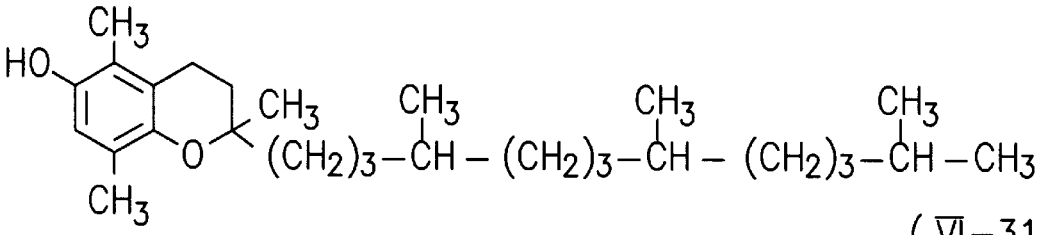
Figure 11E:
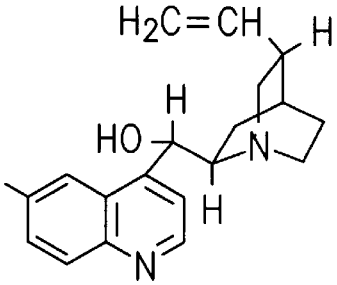
Figure 11E:
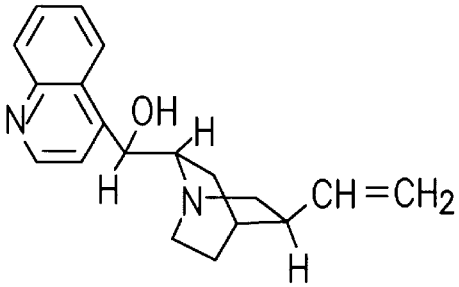
Figure 11E:
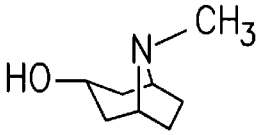
Figure 11E:
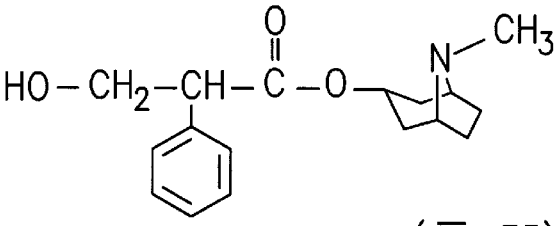
Figure 11E:
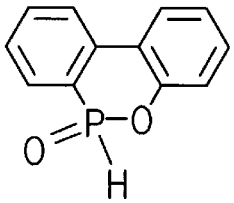
Figure 11E:
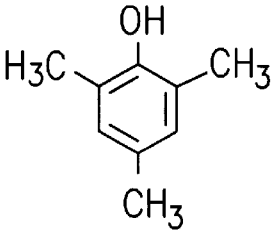
Figure 11E:
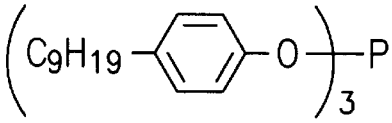
Figure 11F:
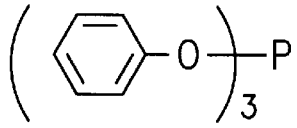
Figure 11F:
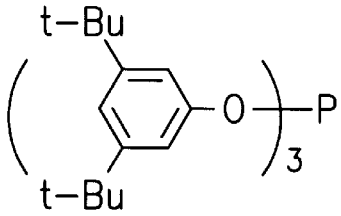
Figure 11F:
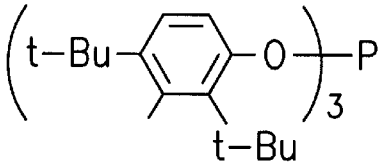
Figure 11F:
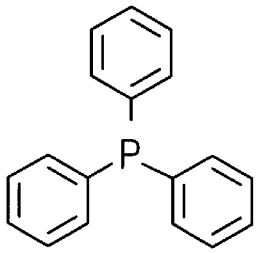
Figure 11F:
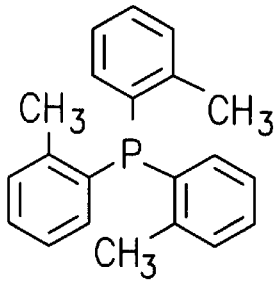
Figure 11F:
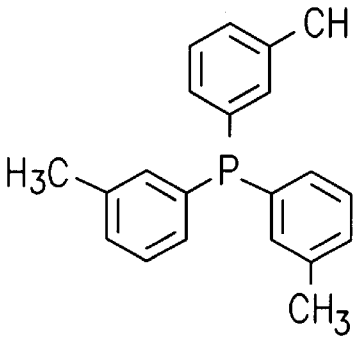
Figure 11F:
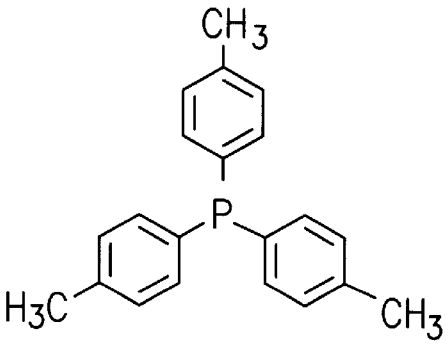

Examples of the resin binder for the charge transport layer include various polycarbonate resins (V-1) through (V-7) described in FIG. 10. Amine antioxidants, phenolic antioxidants, sulfur-containing antioxidants, phosphite antioxidants, phosphor containing antioxidants and benzopinacol antioxidants (VI-1) through (VI-45) described in FIGS. 11(*a*) through 11(*f*) are used in the photoconductive layer to prevent the photoconductive layer from being deteriorated by ozone.

The present invention will be explained hereinafter with reference to the accompanied drawing figures which illustrate the photoconductive layer of the invention that contains the above compounds.

In these figures, the reference numeral 1 designates a conductive substrate, 2 a photoconductive layer, 3 a charge generation layer, 4 a charge transport layer, and 5 a cover layer.

Figure 1:
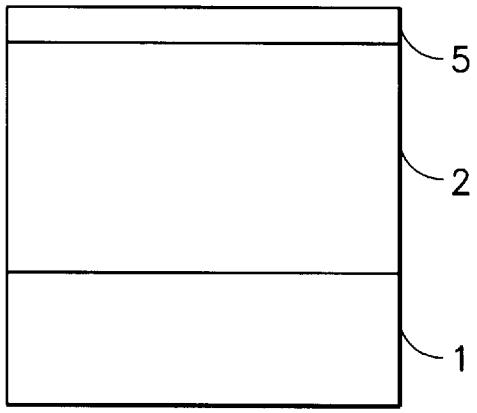
FIG. 1 is a cross section of an electrophotographic photoconductor including a single-layered photoconductive layer according to the present invention.

The photoconductor shown in FIG. 1 is the so-called single-layered photoconductor that includes conductive substrate 1 and photoconductive layer 2 on conductive substrate 1. Photoconductive layer 2 contains a charge generation agent and a furan derivative or a thiophene derivative charge transport agent dispersed into a binder resin. Cover layer 5 is optionally formed on photoconductive layer 2.

Figure 2:
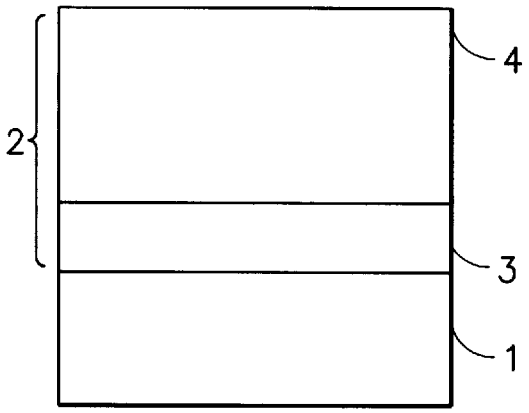
FIG. 2 is a cross section of a laminate-type electrophotographic photoconductor according to the present invention.

The photoconductor shown in FIG. 2 is the so-called laminate-type photoconductor that includes conductive substrate 1 and photoconductive layer 2 that includes charge generation layer 3 containing a charge generation agent and charge transport layer 4 containing a furan derivative or a thiophene derivative charge generation agent.

Figure 3:
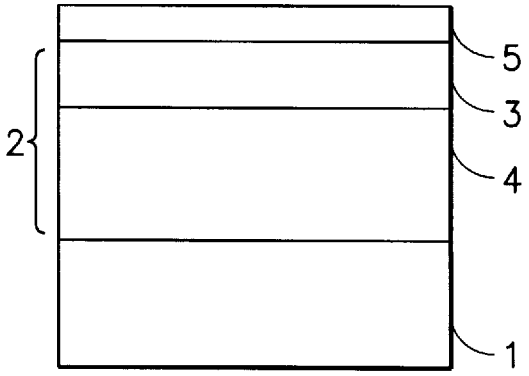
FIG. 3 is a cross section of another laminate-type electrophotographic photoconductor according to the present invention.

The photoconductor shown in FIG. 3 has another laminate structure in which the order of layer lamination is reversed. In this laminate-type photoconductor, cover layer 5 is usually formed to protect charge generation layer 3.

The furan derivative or the thiophene derivative in the present invention performs either (a) as a major charge transport material or (b) as one of additives in a charge transport layer as electron transport substance. In the case of (a), the furan derivative or the thiophene derivative is preferably contained at 30–70 wt %, and more preferably 40–60 wt % in a charge transport layer. In the case of (b), the furan derivative or thiophene derivative is contained preferably at 0.5–5% wt percent in a charge transport layer. In the case of (a), a single layered photosensitive body (FIG. 1) and a laminated photosensitive body of the type substrate/charge generation layer/charge transport layer (FIG. 2) are of a positive charging type. However, in the case of (b), a single layered photosensitive body (FIG. 1) and a laminated photosensitive body of the type substrate/charge transport layer/charge generation layer (FIG. 3) are of a positive charging type, but, a laminated photosensitive body of the type substrate/charge generation layer/charge transport layer (FIG. 2) is of a negative charging type.

The photoconductor shown in FIG. 1 is manufactured, for example, by first preparing a dispersion liquid, prepared by dispersing a charge generation agent into a solution in which a charge transport agent and a binder resin are dissolved, and by coating the thus formed dispersion liquid onto a conductive substrate. If necessary, a cover layer is formed on the photoconductive layer by conventional coating methods.

The photoconductor shown in FIG. 2 is manufactured as follows. The charge generation layer is formed, for example, by either 1) depositing a charge generation agent by vacuum deposition on the conductive substrate, or 2) by coating and drying a dispersion liquid, prepared by dissolving a charge generation agent into a solvent or by prepared by dispersing a charge generation agent into a binder resin, onto the conductive substrate. Then, the charge transport layer is formed by coating and drying a solution, into which a charge transport agent and a binder resin are dissolved, onto the charge generation layer.

The photoconductor shown in FIG. 3 is manufactured as follows. The charge transport layer is formed, for example, by coating and drying a solution, into which was dissolved a charge transport agent and a binder resin are dissolved, on the conductive substrate. Then, the charge generation layer is formed by depositing a charge generation agent by vacuum deposition on the charge transport layer, or by coating and drying a dispersion liquid, prepared by dissolving a charge generation agent into a solvent or by dispersing a charge generation agent into a binder resin, on the charge transport layer. Then, a cover layer is formed on the charge generation layer by the conventional coating methods.

Conductive substrate 1 functions as an electrode of the photoconductor and sustains the layers of the photoconductor. Conductive substrate 1 may be shaped as a cylindrical tube, plate or a film. Metals such as aluminum, stainless steel and nickel or glass and resin, treated to exhibit electrical conduction, are used for the conductive substrate 1. Insulating polymers such as casein, poly(vinyl alcohol), nylon, polyamide, melamine and cellulose, conductive polymers such as polythiophene, polypyrrole and polyaniline or polymers that contain metal oxide powders or low molecular weight compounds can be used for a surface coating for providing the substrate with needed electrical conductivity.

As explained above, charge generation layer 3 is formed by depositing a charge generation agent by vacuum deposition, or by coating and drying a dispersion liquid, prepared by dissolving a charge generation agent into a solvent or by dispersing a charge generation agent into a binder resin. Charge generation layer 3 generates charges in response to the irradiated light.

It is preferable for charge generation layer 3 to exhibit high charge generation efficiency and high efficiency of the generated charge injection into the charge transport layer 4. It is also preferable for the charge injection efficiency not to depend on the electric field and to be high enough even in the low electric field.

Pigments and dyes such as phthalocyanine. (III-1) through (III-6), azo compounds (III-7) through (III-24), their derivatives, metal phthalocyanine such as titanyl phthalocyanine, quinone compounds, indigo compounds, cyanine compounds, squalium compounds, azulenium compounds and pyrilium compounds, selenium, and selenium compounds are used for the charge generation agent. An appropriate charge generation agent may be selected correspond to the wavelength range of the exposure light source used for image formation. The charge generation layer 3 is formed to be 5 μm or less, preferably 2 μm or less, in thickness, since it is enough for the charge generation layer only to exhibit the charge generating function. The charge generation layer may contain a charge transport agent in addition to the charge generation agent as the main component thereof.

Binder resin for the charge generation layer includes polycarbonate, polyester, polyamide, polyurethane, epoxy resin, poly(vinyl butyral), poly(vinyl acetal), phenoxy resin, silicone resin, acrylic resin, vinyl chloride resin, vinylidene chloride resin, vinyl acetate resin, formal resin, cellulose resin, their copolymers, their halides and their cyanoethyl compounds. These binder resins are used alone or in combination.

Charge transport layer 4 is a coating film into that the furan derivative or the thiophene derivative described by the foregoing general formula (I) or (II) is dispersed. Charge transport layer 4 functions in the dark as an insulation layer that retains the charges of the photoconductive layer and transports the charges injected from the charge generation layer during light reception. Various compounds (IV-1) through (IV-12) may be used in combination as the charge transport agent. The charge transport layer 4 is preferably from 10 to 40 μm in thickness. Various polycarbonate resins (V-1) through (V-7), polystyrene, polyacrylate, polyphenylene ether acryl, polyester, polymethacrylate, and their copolymers are used as the resin binder for the charge transport layer.

Amine antioxidants, phenolic antioxidants, sulfur-containing antioxidants, phosphite antioxidants, phosphor containing antioxidants and benzopinacol antioxidants (VI-1) through (VI-45) may be used in the photoconductive layer to prevent the photoconductive layer from being deteriorated by ozone.

Cover layer 5 retains in the dark the charge caused by the corona discharge and transmits the light to that the photoconductive layer is sensitive. It is required for cover layer 5 to transmit the exposure light to the photoconductive layer, to receive the generated charges injected thereto and to neutralize the surface charges. Organic insulating film materials such as polyester and polyamide may be used for the cover layer 5. Inorganic materials such as glass resins and $SiO_2$, and stuffs such as metal and metal oxide which facilitate lowering the electrical resistance may be mixed to the organic insulative film materials. The coating materials are preferably transparent as much as possible in the wavelength region in which the foregoing charge generation agent absorbs light at its maximum.

Though it depends on the composition thereof, the thickness of the cover layer may be set within an arbitrary range in which repeated use of the photoconductor may not cause adverse effects such as residual potential rise.

EMBODIMENTS

The present invention will be explained more in detail by way of the preferred embodiments below.

First through Eighth Embodiments (E1 through E8)

First through eighth embodiments (E1 through E8) are positive-charging photoconductors.

First Embodiment (E1)

Coating liquid for the photoconductive layer was prepared by mixing 20 weight parts of X-type metal-free phthalocyanine (hereinafter abbreviated as "H2Pc"), 100 weight parts of a furan derivative (I-1), 100 weight parts of polyester resin (VYLON 200 supplied from TOYO BO. CO., LTD.) and tetrahydrofuran solvent in a mixer for 3 hr. The coating liquid was coated on an aluminum conductive substrate, 30 mm in outer diameter and 260 mm in length, such that the photoconductive layer may be 10 μm in thickness after drying.

Second Embodiment (E2)

Coating liquid for the charge generation layer was prepared by mixing 70 weight parts of titanyl phthalocyanine (hereinafter abbreviated as "TiOPc"), 30 weight parts of vinyl chloride copolymer and methylene chloride in a mixer for 3 hr. The charge generation layer was formed on an aluminum substrate by coating the thus prepared coating liquid such that the charge generation layer may be about 1 μm in thickness. Then, coating liquid for the charge transport layer was prepared by mixing 100 weight parts of a furan derivative (I-5), 100 weight parts of polycarbonate resin (PCZ-200 supplied from MITSUBISHI GAS CHEMICAL COMPANY, INC.), 0.1 weight parts of silicone oil (KP-340, supplied by Shinetsu Silicone Co., Ltd.) and methylene chloride. Finally, the coating liquid for the charge transport layer was coated on the charge generation layer such that charge transport layer may be about 10 μm in thickness.

Third Embodiment (E3)

Figure 12:
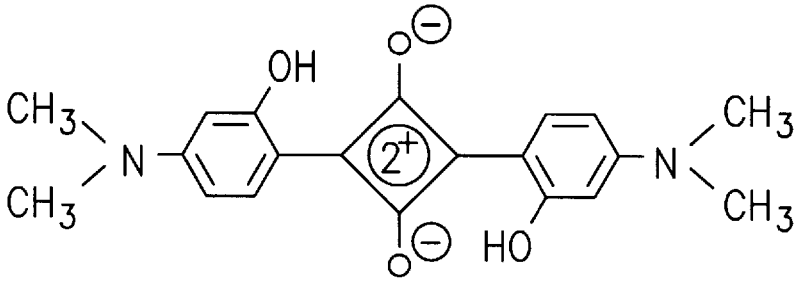
FIG. 12 describes the structural formula of a squalium pigment used in the invention.

The photoconductor of the third embodiment was prepared in the similar manner as the second embodiment except that TiOPc of the second embodiment was replaced by a squalium pigment described by the structural formula in FIG. 12 and the furan derivative (I-5) of the second embodiment by a thiophene derivative (II-4).

Fourth Embodiment (E4)

Figure 13:
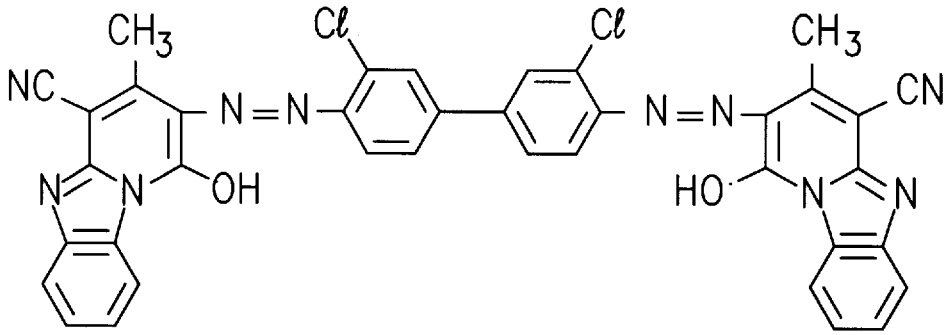
FIG. 13 describes the structural formula of a bisazo pigment used in the invention.

The photoconductor of the fourth embodiment was prepared in the similar manner as the second embodiment except that TiOPc of the second embodiment was replaced by a bisazo pigment described by the structural formula in FIG. 13, the furan derivative (I-5) of the second embodiment by a thiophene derivative (I-13) and a polycarbonate resin (V-4) (TOUGHZET supplied from IDEMITSU KOSAN CO., LTD.) was used in the fourth embodiment.

Fifth Embodiment (E5)

The photoconductor of the fifth embodiment was prepared in the similar manner as the fourth embodiment except that a thiophene derivative (II-1) was used as the charge transport agent of the fifth embodiment.

Sixth Embodiment (E6)

The photoconductor of the sixth embodiment was prepared in the similar manner as the fourth embodiment except that a thiophene derivative (II-2) was used as the charge transport agent in the sixth embodiment.

Seventh Embodiment (E7)

The photoconductor of the seventh embodiment was prepared in the similar manner as the fourth embodiment except that a thiophene derivative (II-4) was used as the charge transport agent in the seventh embodiment.

Eighth Embodiment (E8)

Figure 14:
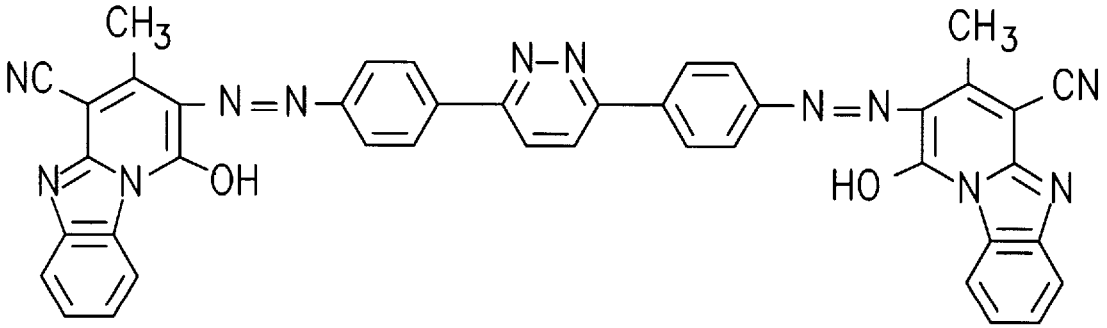
FIG. 14 describes the structural formula of another bisazo pigment used in the invention.

The photoconductor of the eighth embodiment was prepared in the similar manner as the fourth embodiment except that the bisazo pigment of the fourth embodiment was replaced by a bisazo pigment described by the structural formula in FIG. 14 and a furan derivative (I-5) was used as the charge transport agent in the eighth embodiment.

Evaluation

The electrophotographic properties of the photoconductors fabricated as described above were evaluated. Initial surface potential Vs (V) when the photoconductor surface was positively charged by corona discharge at +4.5 kV in the dark and surface potential Vd (V) after the photoconductor had been left in the dark for 5 seconds from the end of the corona discharge were measured. Then, sensitivity E½ (lux·s) was obtained by measuring a period of time (sec) until the surface potential Vd had been halved by irradiation of the white light to the photoconductor surface at the illuminance of 100 lux. Surface potential caused by 10 seconds irradiation of the white light at the illuminance of 100 lux was measured as the residual potential Vr (V).

Since the photoconductors of the first through third embodiments are expected to be highly sensitive at long wavelengths, the electrophotographic properties of the first through third embodiments were measured also at the monochromatic light of 780 nm in wavelength. The surface potential Vs (V) and Vd (V) were measured in the same way as described above. Then, half decay exposure light quantity ($\mu J/cm^2$) was measured by irradiation of the monochromatic light (780 nm) of 1 $\mu$W in place of the white light irradiation. Residual potential Vr (V) was measured by irradiating the monochromatic light for 10 seconds. The results of the evaluation are listed in Table 1.

TABLE 1

| | White light | | Monochromatic light (780 nm) | |
|---|---|---|---|---|
| | Sensitivity $E_{1/2}$ (lux · s) | Residual potential (V) | Half decay exposure light quantity ($\mu J/cm^2$) | Residual potential (V) |
| Embodiment 1 | 13.5 | 120 | 1.11 | 85 |
| Embodiment 2 | 6.6 | 40 | 6.9 | 70 |
| Embodiment 3 | 7.5 | 90 | 10.2 | 75 |
| Embodiment 4 | 8.8 | 40 | — | — |
| Embodiment 5 | 11.3 | 90 | — | — |
| Embodiment 6 | 9.3 | 70 | — | — |
| Embodiment 7 | 10.0 | 60 | — | — |
| Embodiment 8 | 12.8 | 100 | — | — |

Ninth through Twenty Fourth Embodiments (E9 through E24), & Comparative Examples 1 through 5

Ninth through twenty fourth embodiments (E9 through E24) and comparative examples 1 through 5 (C1 through C5) are negative-charging laminate-type photoconductors for which aluminum cylindrical substrates, 1 mm in thickness, 310 mm in length and 60 mm in outer diameter were used. The aluminum cylindrical substrates were cleaned and dried before use.

Ninth Embodiment (E9)

Coating liquid for resin coat film was prepared by dissolving 10 weight parts of alcohol-soluble polyamide copolymer resin (CM 8000 supplied from TORAY INDUSTRIES, INC.) into solvent mixture of 45 weight parts of methanol and 45 weight parts of methylene chloride. The coating liquid was coated on the aluminum cylindrical substrate tube by dip-coating and, then dried at 90° C. for 30 min to form a resin coat film of 0.1 $\mu$m in thickness for an intermediate layer.

Then, coating liquid for the charge generation layer was prepared by dispersing 1 weight part of poly(vinyl acetal) resin (S.LEC KS-1 supplied from Sekisui Chemical Co., Ltd.) and 1 weight part of a bisazo charge generation agent (III-17) into 150 weight parts of methyl ethyl ketone in a ball mill for 24 hr. A charge generation layer of 0.2 $\mu$m in thickness was formed on the intermediate layer by dip-coating of the coating liquid and by drying the coating liquid at 90° C. for 30 min.

Then, coating liquid for the charge transport layer was prepared by dissolving 50 weight parts of a hydrazone compound (IV-1), 50 weight parts of another hydrazone compound (IV-2), 100 weight parts of bisphenol A-type-biphenyl polycarbonate copolymer (V-4) (TOUGHZET supplied from IDEMITSU KOSAN CO., LTD.), 5 weight parts of a hindered phenolic compound (VI-2) and 1 weight part of a furan derivative (I-1) into 700 weight parts of dichloromethane. A charge transport layer of 20 $\mu$m in thickness was formed on the charge generation layer by coating the coating liquid and by drying the coating liquid at 90° C. for 30 min.

Tenth Embodiment (E10)

The photoconductor of the tenth embodiment was prepared in the similar manner as the ninth embodiment except that a furan derivative (I-5) was used in the tenth embodiment in place of the furan derivative (I-1) of the ninth embodiment.

Eleventh Embodiment (E11)

The photoconductor of the eleventh embodiment was prepared in the similar manner as the ninth embodiment except that a thiophene derivative (I-9) was used in the eleventh embodiment in place of the furan derivative (I-1) of the ninth embodiment.

Twelfth Embodiment (E12)

The photoconductor of the twelfth embodiment was prepared in the similar manner as the ninth embodiment except that a thiophene derivative (I-16) was used in the twelfth embodiment in place of the furan derivative (I-1) of the ninth embodiment.

Thirteenth Embodiment (E13)

The photoconductor of the thirteenth embodiment was prepared in the similar manner as the ninth embodiment except that a thiophene derivative (II-1) was used in the thirteenth embodiment in place of the furan derivative (I-1) of the ninth embodiment.

Fourteenth Embodiment (E14)

The photoconductor of the fourteenth embodiment was prepared in the similar manner as the ninth embodiment except that a thiophene derivative (II-4) was used in the fourteenth embodiment in place of the furan derivative (I-1) of the ninth embodiment.

Fifteenth Embodiment (E15)

The photoconductor of the fifteenth embodiment was prepared in the similar manner as the ninth embodiment except that a furan derivative (II-7) was used in the fifteenth embodiment in place of the furan derivative (I-1) of the ninth embodiment.

Sixteenth Embodiment (E16)

The photoconductor of the sixteenth embodiment was prepared in the similar manner as the ninth embodiment except that a furan derivative (II-10) was used in the sixteenth embodiment in place of the furan derivative (I-1) of the ninth embodiment.

Seventeenth Embodiment (E17)

The photoconductor of the seventeenth embodiment was prepared in the similar manner as the ninth embodiment except that a bisazo charge generation agent (III-7) was used in the seventeenth embodiment in place of the charge generation agent (III-17) of the ninth embodiment.

Eighteenth Embodiment (E18)

The photoconductor of the eighteenth embodiment was prepared in the similar manner as the ninth embodiment except that a bisazo charge generation agent (III-24) was used in the eighteenth embodiment in place of the charge generation agent (III-17) of the ninth embodiment.

Nineteenth Embodiment (E19)

The photoconductor of the nineteenth embodiment was prepared in the similar manner as the ninth embodiment except that the charge transport agents of the ninth embodiment was replaced by 50 weight parts of a hydrazone compound (IV-3) and 50 weight parts of a butadiene compound (IV-4) in the nineteenth embodiment.

Twentieth Embodiment (E20)

The photoconductor of the twentieth embodiment was prepared in the similar manner as the ninth embodiment except that the charge transport agents of the ninth embodiment was replaced by 50 weight parts of a diamine compound (IV-10) and 50 weight parts of a distyryl compound (IV-11) in the twentieth embodiment.

Twenty First Embodiment (E21)

The photoconductor of the twenty first embodiment was prepared in the similar manner as the ninth embodiment except that the resin (V-4) of the ninth embodiment was replaced by a polycarbonate resin (V-2) in the twenty first embodiment.

Twenty Second Embodiment (E22)

The photoconductor of the twenty second embodiment was prepared in the similar manner as the ninth embodiment except that the resin (V-4) of the ninth embodiment was replaced by a polycarbonate resin (V-6) in the twenty second embodiment.

Twenty Third Embodiment (E23)

The photoconductor of the twenty third embodiment was prepared in the similar manner as the ninth embodiment except that the antioxidant (VI-2) of the ninth embodiment was replaced by an antioxidant (VI-30) in the twenty third embodiment.

Twenty Fourth Embodiment (E24)

The photoconductor of the twenty fourth embodiment was prepared in the similar manner as the ninth embodiment except that the antioxidant (VI-2) of the ninth embodiment was replaced by an antioxidant (VI-37) in the twenty fourth embodiment.

Comparative Example 1 (C1)

The photoconductor of the comparative example 1 was prepared in the similar manner as the ninth embodiment except that the furan derivative of the ninth embodiment was not contained in the charge transport layer of the comparative example 1.

Comparative Example 2 (C2)

The photoconductor of the comparative example 2 was prepared in the similar manner as the seventeenth embodiment except that the furan derivative of the seventeenth embodiment was not contained in the charge transport layer of the comparative example 2.

Comparative Example 3 (C3)

The photoconductor of the comparative example 3 was prepared in the similar manner as the nineteenth embodiment except that the furan derivative of the nineteenth embodiment was not contained in the charge transport layer of the comparative example 3.

Comparative Example 4 (C4)

The photoconductor of the comparative example 4 was prepared in the similar manner as the twenty first embodiment except that the furan derivative of the twenty first embodiment was not contained in the charge transport layer of the comparative example 4.

Comparative Example 5 (C5)

The photoconductor of the comparative example 5 was prepared in the similar manner as the twenty third embodiment except that the furan derivative of the twenty third embodiment was not contained in the charge transport layer of the comparative example 5.

Evaluation

The electrophotographic properties of the photoconductors of the ninth through twenty fourth embodiments and the comparative examples 1 through 5 were evaluated in the following way.

The surface potential when the photoconductor surface was negatively charged by corona discharge at −6.0 kV in the dark for 10 seconds and surface potential after the photoconductor had been left in the dark for 5 seconds from the end of the corona discharge were measured, and the retention rate VK5 of the surface potential 5 seconds afterward the corona discharge was obtained. Then, the half decay exposure light quantity $E_{1/2}$ (lux·s) was obtained by measuring a period of time (sec) until the surface potential had been halved by irradiation of the white light to the photoconductor surface at the illuminance of 2 lux.

The change of the surface potential during continuous use of the photoconductor was evaluated in an analog copying machine provided with the scrotron charging process and two-components developing mechanism. The charging mechanism, exposure mechanism and charge removal mechanism of the analog copying machine were fixed at certain outputs. Each photoconductor subjected to a running test that prints 50000 sheets of A4-size paper in an ordinary temperature and ordinary humidity environment. White paper potential Vw and black paper potential Vb were measured at the start and end of the running test, and the potential changes ΔVw and ΔVb were obtained. Table 2 lists the results.

TABLE 2

| Specimen | Furan or thiophene | Charge generation agent | Charge transport agent | | Binder resin | Anti-oxidant | VK5 (%) | $E_{1/2}$ (lux.s) | Running test: Initial Vw (V) | Initial Vb (V) | Change Δ Vw (V) | Change Δ Vb (V) |
|---|---|---|---|---|---|---|---|---|---|---|---|---|
| E 9 | I-1 | III-17 | IV-1 | IV-2 | V-4 | VI-2 | 96.9 | 0.90 | −47 | −605 | 3 | −2 |
| E 10 | I-5 | III-17 | IV-1 | IV-2 | V-4 | VI-2 | 98.0 | 0.99 | −45 | −603 | 3 | −1 |
| E 11 | I-9 | III-17 | IV-1 | IV-2 | V-4 | VI-2 | 95.6 | 1.02 | −45 | −605 | 0 | −3 |
| E 12 | I-16 | III-17 | IV-1 | IV-2 | V-4 | VI-2 | 96.5 | 0.99 | −44 | −603 | 5 | 0 |
| E 13 | II-1 | III-17 | IV-1 | IV-2 | V-4 | VI-2 | 97.0 | 0.89 | −48 | −604 | 4 | 2 |
| E 14 | II-4 | III-17 | IV-1 | IV-2 | V-4 | VI-2 | 95.6 | 0.60 | −47 | −605 | 0 | −3 |
| E 15 | II-7 | III-17 | IV-1 | IV-2 | V-4 | VI-2 | 95.2 | 0.90 | −45 | −607 | 3 | −3 |
| E 16 | II-10 | III-17 | IV-1 | IV-2 | V-4 | VI-2 | 96.2 | 1.02 | −45 | −605 | 0 | −1 |
| E 17 | I-1 | III-7 | IV-1 | IV-2 | V-4 | VI-2 | 96.8 | 0.95 | −45 | −607 | 5 | −3 |
| E 18 | I-1 | III-24 | IV-1 | IV-2 | V-4 | VI-2 | 96.7 | 0.92 | −45 | −605 | 4 | −1 |
| E 19 | I-1 | III-17 | IV-3 | IV-4 | V-4 | VI-2 | 97.2 | 0.90 | −45 | −605 | 2 | −4 |
| E 20 | I-1 | III-17 | IV-10 | IV-11 | V-4 | VI-2 | 96.5 | 0.96 | −45 | −607 | 5 | 0 |
| E 21 | I-1 | III-17 | IV-1 | IV-2 | V-2 | VI-2 | 97.4 | 1.02 | −45 | −605 | 4 | −3 |
| E 22 | I-1 | III-17 | IV-1 | IV-2 | V-6 | VI-2 | 95.8 | 1.00 | −45 | −607 | 2 | −5 |
| E 23 | I-1 | III-47 | IV-1 | IV-2 | V-4 | VI-30 | 95.6 | 0.95 | −45 | −605 | −1 | −1 |
| E 24 | I-1 | III-17 | IV-1 | IV-2 | V-4 | VI-37 | 97.8 | 0.98 | −45 | −605 | 2 | −2 |
| C 1 | — | III-17 | IV-1 | IV-2 | V-4 | VI-2 | 96.0 | 0.99 | −45 | −610 | 82 | −26 |
| C 2 | — | III-7 | IV-1 | IV-2 | V-4 | VI-2 | 97.0 | 0.95 | −46 | −608 | 55 | −19 |
| C 3 | — | III-17 | IV-3 | IV-4 | V-4 | VI-2 | 95.5 | 1.03 | −45 | −605 | 59 | −28 |
| C 4 | — | III-17 | IV-1 | IV-2 | V-2 | VI-2 | 97.4 | 1.03 | −44 | −609 | 76 | −16 |
| C 5 | — | III-17 | IV-1 | IV-2 | V-4 | VI-30 | 95.2 | 1.01 | −45 | −605 | 93 | −18 |

As Table 2 clearly indicates, the comparative photoconductors (C1 through C5) which do not contain any furan derivative or thiophene derivative in their charge transport layers exhibit much larger potential changes after the repeated printings as compared with the photoconductors of the ninth through twenty fourth embodiments (E9 through E24). That is, the comparative photoconductors do not exhibit excellent electrophotographic properties. If the ninth embodiment (E9) is compared with the seventeenth and eighteenth embodiments (E17 and E18), we see that stable electrophotographic properties are obtained as far as any one of the furan derivatives or thiophene derivatives is contained in the charge transport layer.

Since the favorable effect of the furan derivatives or thiophene derivatives is apparent in the embodiments where the other components were changed, it is apparent that the present invention can be used in many different constituent configurations. It is seen that in the eighteenth and twentieth embodiments (E18 and E20) in which the charge transport agents are changed, in the twenty first and twenty second embodiments (E21 and E22) in which the resin binder for the charge transport layer is changed, as well as in the twenty third and twenty fourth embodiments (E23 and E24) in which the antioxidant is changed, the furan derivatives and the thiophene derivatives of the invention are applicable to various compositions for the electrophotographic photoconductor.

By containing anyone of the furan derivatives or thiophene derivatives in the charge transport layer, the photoconductors for the printers, digital copying machines and facsimiles which contain anyone of the metal free phthalocyanine and titanyl phthalocyanine (III-1) through (III-6) exhibits the similar effects as those of the photoconductors of the foregoing embodiments which contain the azo compound for use in the analog copying machines.

By containing anyone of the furan derivatives or thiophene derivatives in the charge transport layer, the photoconductors, which employ the corotron method, which employ charging brush method, which employ charging roller method and which employ the single-component development method, for various analog copying machines, digital copying machines, printers and facsimiles exhibit excellent stability against repeated use similarly as the photoconductors of the foregoing embodiments (E9 through E24) which employ the scrotron method and two-components development method do.

By containing at least one of the furan derivatives and thiophene derivatives described by the general formulas (I) and (II) as the charge transport agent in the photoconductive layer according to the invention, a highly sensitive electrophotographic photoconductor, that is stabile enough to endure repeated continuous use for a long time in practical electrophotographic processes, is obtained.

According to the present invention, a highly sensitive electrophotographic photoconductor that exhibits excellent electrical properties is obtained.

By selecting an appropriate charge generating agent from, e.g., the phthalocyanine compounds, squalium compounds and some kinds of bisazo compound corresponding to the wavelength of the exposure light, the photoconductor of the invention is applicable to various copying machines and semiconductor laser printers. The durability of the photoconductor of the invention is improved, if necessary, by covering the photoconductor surface with a cover layer.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

Although only a single or few exemplary embodiments of this invention have been described in detail above, those skilled in the art will readily appreciate that many modifications are possible in the exemplary embodiment (s) without materially departing from the novel teachings and advantages of this invention. Accordingly, all such modifications are intended to be included within the scope of this invention as defined in the following claims, In the claims, means-plus-function clauses are intended to cover the structures described herein as performing the recited function and not only structural equivalents but also equivalent structures, This although a nail and screw may not be structural equivalents in that a nail relies entirely on friction between a wooden part and a cylindrical surface whereas a screw's helical surface positively engages the wooden part in the environment of fastening wooden parts, a nail and a screw may be equivalent structures.

What is claimed is:

1. An electrophotographic photoconductor comprising:

a conductive substrate;

a photoconductive layer on said conductive substrate;

said photoconductive layer comprising at least one charge transport agent;

said charge transport agent comprising at least one furan derivative or thiophene derivative;

said furan derivative and thiophene derivative being described by the following general formula (I):

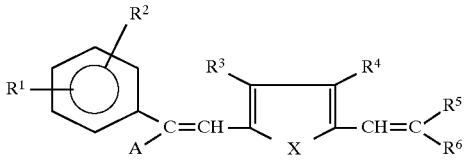

(I)

A being a hydrogen atom, substituted or non-substituted alkyl group, or substituted or non-substituted aromatic group;

$R^1$ being a hydrogen atom, halogen atom, substituted or non-substituted alkyl group, alkoxy group, alkylamino group, nitro group, cyano group, substituted or non-substituted aromatic group, or substituted or non-substituted heterocyclic group;

$R^2$ being a hydrogen atom, halogen atom, substituted or non-substituted alkyl group, alkoxy group, alkylamino group, nitro group, cyano group, substituted or non-substituted aromatic group, or substituted or non-substituted heterocyclic group;

$R^3$ being a hydrogen atom, halogen atom, substituted or non-substituted alkyl group, or substituted or non-substituted aromatic group;

$R^4$ being a hydrogen atom, halogen atom, substituted or non-substituted alkyl group, or substituted or non-substituted aromatic group;

$R^5$ being a cyano group, or alkoxycarbonyl group;

$R^6$ being a cyano group, or alkoxycarbonyl group; and

X being an oxygen atom or sulfur atom.

2. An electrophotographic photoconductor comprising:

a conductive substrate;

a photoconductive layer on said conductive substrate;

said photoconductive layer comprising at least one of charge transport agents;

said charge transport agents comprising furan derivatives and thiophene derivatives;

said furan derivatives and thiophene derivatives being described by the following general formula (II):

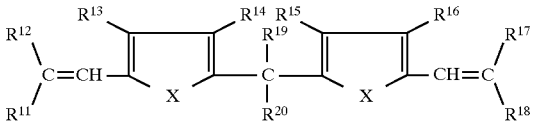

(II)

$R^{13}$ being a hydrogen atom, halogen atom, substituted or non-substituted alkyl group, substituted or non-substituted aromatic group, or substituted or non-substituted heterocyclic group;

$R^4$being a hydrogen atom, halogen atom, substituted or non-substituted alkyl group, substituted or non-substituted aromatic group, or substituted or non-substituted heterocyclic group;

$R^{15}$ being a hydrogen atom, halogen atom, substituted or non-substituted alkyl group, substituted or non-substituted aromatic group, or substituted or non-substituted heterocyclic group;

$R^{16}$ being a hydrogen atom, halogen atom, substituted or non-substituted alkyl group, substituted or non-substituted aromatic group, or substituted or non-substituted heterocyclic group;

$R^{19}$ being a hydrogen atom, substituted or non-substituted alkyl group, or substituted or non-substituted aromatic group;

$R^{20}$ being a hydrogen atom, substituted or non-substituted alkyl group, or substituted or non-substituted aromatic group;

$R^{11}$ being a cyano group , or alkoxycarbonyl group;

$R^{12}$ being a cyano group, or alkoxycarbonyl group;

$R^{17}$ being a cyano group, or alkoxycarbonyl group;

$R^{18}$ being a cyano group, or alkoxycarbonyl group; and

X being an oxygen atom or sulfur atom.

3. The electrophotographic photoconductor according to claim 2, wherein said $R^{19}$ and $R^{20}$ form a ring.

* * * * *